US008639502B1

(12) United States Patent
Boucheron et al.

(10) Patent No.: US 8,639,502 B1
(45) Date of Patent: Jan. 28, 2014

(54) SPEAKER MODEL-BASED SPEECH ENHANCEMENT SYSTEM

(75) Inventors: Laura E. Boucheron, Las Cruces, NM (US); Phillip L. De Leon, Las Cruces, NM (US)

(73) Assignee: Arrowhead Center, Inc., Las Cruces, NM (US)

( * ) Notice: Subject to any disclaimer, the term of this patent is extended or adjusted under 35 U.S.C. 154(b) by 1018 days.

(21) Appl. No.: 12/706,482

(22) Filed: Feb. 16, 2010

Related U.S. Application Data

(60) Provisional application No. 61/152,903, filed on Feb. 16, 2009.

(51) Int. Cl.
*G10L 21/00* (2013.01)

(52) U.S. Cl.
USPC ..... 704/226; 704/233; 381/94.1

(58) Field of Classification Search
USPC ..... 704/226, 233; 381/94.1
See application file for complete search history.

(56) References Cited

U.S. PATENT DOCUMENTS

| | | | | |
|---|---|---|---|---|
| 5,963,899 | A | 10/1999 | Bayya et al. | |
| 6,173,258 | B1 * | 1/2001 | Menendez-Pidal et al. | 704/233 |
| 6,381,571 | B1 | 4/2002 | Gong et al. | |
| 6,633,842 | B1 | 10/2003 | Gong | |
| 6,944,590 | B2 * | 9/2005 | Deng et al. | 704/228 |
| 6,990,447 | B2 * | 1/2006 | Attias et al. | 704/240 |
| 7,047,047 | B2 | 5/2006 | Acero et al. | |
| 7,062,433 | B2 | 6/2006 | Gong | |
| 7,165,026 | B2 | 1/2007 | Acero et al. | |
| 7,165,028 | B2 | 1/2007 | Gong | |
| 7,328,154 | B2 | 2/2008 | Mutel et al. | |
| 7,418,383 | B2 | 8/2008 | Droppo et al. | |
| 7,451,083 | B2 | 11/2008 | Frey et al. | |
| 7,454,338 | B2 | 11/2008 | Seltzer et al. | |
| 7,457,745 | B2 | 11/2008 | Kadambe et al. | |
| 7,617,098 | B2 * | 11/2009 | Deng et al. | 704/226 |
| 2002/0173959 | A1 | 11/2002 | Gong | |
| 2004/1090732 | | 9/2004 | Acero et al. | |
| 2005/0182624 | A1 | 8/2005 | Wu et al. | |
| 2006/0206322 | A1 * | 9/2006 | Deng et al. | 704/226 |
| 2007/0033028 | A1 | 2/2007 | Yao | |
| 2007/0033042 | A1 | 2/2007 | Marcheret et al. | |
| 2007/0260455 | A1 | 11/2007 | Akamine et al. | |
| 2007/0276662 | A1 | 11/2007 | Akamine et al. | |
| 2008/0010065 | A1 | 1/2008 | Bratt et al. | |
| 2008/0059181 | A1 * | 3/2008 | Deligne et al. | 704/251 |
| 2008/0065380 | A1 | 3/2008 | Kwak et al. | |
| 2008/0300875 | A1 | 12/2008 | Yao et al. | |
| 2009/0076813 | A1 | 3/2009 | Jung et al. | |

OTHER PUBLICATIONS

Abe, M. et al., "Voice conversion through vector quantization", *Proc. ICASSP 1988* , 655-658.

(Continued)

*Primary Examiner* — Daniel D Abebe
(74) *Attorney, Agent, or Firm* — Jeffrey D. Myers; Peacock Myers, P.C.

(57) ABSTRACT

A speech enhancement method (and concomitant computer-readable medium comprising computer software encoded thereon) comprising receiving samples of a user's speech, determining mel-frequency cepstral coefficients of the samples, constructing a Gaussian mixture model of the coefficients, receiving speech from a noisy environment, determining mel-frequency cepstral coefficients of the noisy speech, estimating mel-frequency cepstral coefficients of clean speech from the mel-frequency cepstral coefficients of the noisy speech and from the Gaussian mixture model, and outputting a time-domain waveform of enhanced speech computed from the estimated mel-frequency cepstral coefficients.

20 Claims, 9 Drawing Sheets

(56) References Cited

OTHER PUBLICATIONS

Berouti, M. et al., "Enhancement of speech corrupted by acoustic noise", *Proc. IEEE Int. Conf. Acoust., Speech, Signal Process* (*ICASSP*) 1979 , 208-211.
Boll, S. , "Suppression of acoustic noise in speech using spectral subtraction", *IEEE Trans. Acoust. Speech, Signal Process*. vol. ASSP-27, No. 2 Apr. 1979 , 113-120.
Boucheron, L. E. et al., "On the inversion of mel-frequency cepstral coefficients for speech enhancement applications", *Proc. Int. Conf. Signals and Electronic Systems* (*ICSES*) Sep. 2008.
Davis, S. B. et al., "Comparison of parametric representations for monosyllabic word recognition in continuously spoken sentences", *IEEE Trans. Acoust. Speech, Signal Process*. vol. ASSP-28, No. 4 Aug. 1980 , 357-366.
Deng, L. et al., "Estimating cepstrum of speech under the presence of noise using a joint prior of static and dynamic features", *IEEE Trans. Speech Audio Process*. vol. 12, No. 3 May 2004 , 218-233.
Ephraim, Y. et al., "Speech enhancement using a minimum mean-square error log-spectral amplitude estimator", *IEEE Trans. Acoust., Speech, Signal Process*. vol. ASSP-33, No. 2 Apr. 1985 , 443-445.
Ephraim, Y. et al., "Speech enhancement using a minimum mean-square error short-time spectral amplitude estimator", *IEEE Trans. Acoust., Speech, Signal Process*. vol. ASSP-32, No. 6 Dec. 1984 , 1109-1121.
Hu, Y. et al., "A generalized subspace approach for enhancing speech corrupted by colored noise", *IEEE Trans. Speech Audio Process*. vol. 11, No. 4 Jul. 2003 , 334-341.
Hu, Y. et al., "Evaluation of objective quality measures for speech enhancement", *IEEE Trans. Audio, Speech, Language Process*. vol. 16, No. 1 Jan. 2008 , 229-238.
Bogert, B. P. et al., "The quefrency alanysis of time series for echoes: cepstrum, pseudo-autocovariance, cross-cepstrum, and saphe tracking", *Proc. Symp. on Time Series Analysis* M. Rosenblatt, Ed., Wiley 1963 , 209-243.
Fisher, W. M. et al., "The DARPA speech recognition research database: Specifications and status", *Proc. DARPA Workshop on Speech Recognition* 1986.
Griffin, D. W. et al., "Signal estimation from modified short-term fourier transform", *IEEE Transactions on Acoustics, Speech, and Signal Processing* vol. ASSP-32, No. 2 Apr. 1984 , 236-243.
Kundu, A. et al., "GMM based Bayesian approach to speech enhancement in signal/transform domain", *Proc. IEEE Int. Conf. Acoust., Speech, Signal Process.* (*ICASSP*) 2008 , 4893-4896.
Kundu, A. et al., "Speech enhancement using intra-frame dependency in DCT domain", *Proc. European Signal Process. Conf.* (*EUSIPCO*) 2008.
Lim, J. et al., "All-pole modeling of degraded speech", *IEEE Trans. Acoust., Speech, Signal Process*. vol. ASSP-26, No. 3 Mar. 1978, 197-210.
Molau, Sirko et al., "Computing Mel-Frequency Cepstral Coefficients on the Power Spectrum", http://www.i6.informatik.rwth-aachen.de/publications/download/474/Molau-ICASSP-2001.pdf 2001.
Mouchtaris, A. et al., "A spectral conversion approach to single-channel speech enhancement", *IEEE Trans. Audio, Speech, Language Process*. vol. 15, No. 4 May 2007 , 1180-1193.
Pearce, D. , "Enabling new speech driven services for mobile devices: An overview of the ETSI standards activities for distribute speech recognition front-ends", *In Proc. AVIOS 2000: The Speech Applications Conference*, San Jose, CA. 2000.
Ramachandran, R. P. et al., "Speaker recognition-general classifier approaches and data fusion methods", *Pattern Recognition* vol. 35 2002 , 2801-2821.
Reynolds, D. A. , "Automatic speaker recognition using Gaussian mixture speaker models", *The Lincoln Laboratory Journal* vol. 8, No. 2 1995 , 173-192.
Reynolds, D. A. et al., "Robust text-independent speaker identification using Gaussian mixture speaker models", *IEEE Trans. Speech Audio Process*. vol. 3, No. 1 Jan. 1995 , 72-83.
Scalart, P. et al., "Speech enhancement based on a priori signal-to-noise estimation", *Proc. IEEE Int. Conf. Acoust., Speech, Signal Process.* (*ICASSP*) 1996 , 629-632.
Varga, A. et al., "Assessment for automatic speech recognition: II. NOISEC-92: A database and an experiment to study the effect of additive noise on speech recognition systems", *Speech Comm.* vol. 12, No. 3 1993 , 247-251.

* cited by examiner

SPEAKER MODEL-BASED SPEECH ENHANCEMENT SYSTEM

CROSS-REFERENCE TO RELATED APPLICATIONS

This application claims priority to and the benefit of the filing of U.S. Provisional Patent Application Ser. No. 61/152,903, entitled "Speaker Model-Based Speech Enhancement System", filed on Feb. 16, 2009, and the specification thereof is incorporated herein by reference.

STATEMENT REGARDING FEDERALLY SPONSORED RESEARCH OR DEVELOPMENT

This invention was made with Government support under Agreement No. NMA-401-02-9 awarded by the National Geospatial Intelligence Agency. The Government has certain rights in the invention.

INCORPORATION BY REFERENCE OF MATERIAL SUBMITTED ON A COMPACT DISC

Not Applicable.

COPYRIGHTED MATERIAL

Not Applicable.

BACKGROUND OF THE INVENTION

1. Field of the Invention (Technical Field)

The present invention relates to speech enhancement methods, apparatuses, and computer software, particularly for noisy environments.

2. Description of Related Art

Note that the following discussion refers to a number of publications by author(s) and year of publication, and that due to recent publication dates certain publications are not to be considered as prior art vis-a-vis the present invention. Discussion of such publications herein is given for more complete background and is not to be construed as an admission that such publications are prior art for patentability determination purposes.

Enhancement of noisy speech remains an active area of research due to the difficulty of the problem. Standard methods such as spectral subtraction, iterative Wiener filtering can increase signal-to-noise-ratio (SNR) or improve perceptual evaluation of speech quality (PESQ) scores but at the expense of other distortions such as musical artifacts. Other methods have recently been proposed, such as the generalized subspace method, which can deal with non-white additive noise. With all of these methods, PESQ can be improved by as much as 0.6 for speech with 10 to 30 dB input SNR. The effectiveness of these methods deteriorates rapidly below 5 dB input SNR.

Gaussian Mixture Models (GMMs) of a speaker's mel-frequency cepstral coefficient (MFCC) vectors have been successfully used for over a decade in speaker recognition (SR) systems. Due to the non-deterministic aspects of speech, it is desirable to model each acoustic class with a Gaussian probability density function since the actual sound produced for the same acoustic class will vary from instance to instance. Since GMMs can model arbitrary distributions, they are well suited to modeling speech for speech recognition (SR) systems, whereby each acoustic class is modeled by a single component density.

The use of cepstral- or GMM-based systems for speech enhancement has only recently been investigated. Compared to most speech enhancement algorithms, which do not require clean speech signals for training, recent research has assumed the availability of a clean speech signal to build user-dependent models to enhance noisy speech.

Kundu et al., "GMM based Bayesian approach to speech enhancement in signal/transform domain", in Proc. IEEE Int. Conf. Acoust., Speech, Signal Process. (ICASSP), pp. 4893-4896, April 2008, build a GMM of vectors containing time-domain samples (speech frames) from a group of speakers during the training stage. In the enhancement stage, the minimum mean-square error (MMSE) estimate of each noisy speech frame is computed, relying on the time-domain independence of the noise and speech. The authors report up to 11 dB improvement in output SNR for low input SNR (−5 to 10 dB) with additive white Gaussian noise.

Kundu et al., "Speech Enhancement Using Intra-frame Dependency in DCT Domain", in Proc. European Signal Processing Conference (EUSIPCO), August 2008, extended their work whereby a discrete cosine transform (DCT) is used to decorrelate the time-domain samples. The decorrelated samples of the speech frame can then be split into subvectors for individual modeling by a GMM. The authors achieved 6-10 dB improvement in output SNR and 0.2-0.8 PESQ improvement for input SNRs of 0 to 10 dB for a variety of noise types.

Mouchtaris et al., "A spectral conversion approach to single-channel speech enhancement", IEEE Trans. Audio, Speech, Language Process., vol. 15, no. 4, pp. 1180-1193, May 2007, build a GMM of a distribution of vectors containing the line spectral frequencies (LSFs) for the (assumed) jointly Gaussian speech and noisy speech. Enhancement for a separate speaker and noise pair is estimated based on a probabilistic linear transform, and the enhanced LSFs are used to estimate a linear filter for speech synthesis (iterative Wiener or Kalman filter). The authors report an output average segmental SNR value from 3-13 dB for low input SNR (−5 to 10 dB) with additive white Gaussian noise.

Deng et al., "Estimating cepstrum of speech under the presence of noise using a joint prior of static and dynamic features", IEEE Trans. Speech Audio Process., vol. 12, no. 3, pp. 218-233, May 2004, use MFCCs and Δ-MFCCs to model clean speech, a separate recursive algorithm to estimate the noise, and construct a linearized model of the nonlinear acoustic environment via a truncated Taylor series approximation (using an iterative algorithm to compute the expansion point). Results are measured by improvement in speech recognition accuracy, with word recognition rates between 54% and 99% depending on noise type and SNR.

The present invention provides a two-stage speech enhancement technique which uses GMMs to model the MFCCs from clean and noisy speech. A novel acoustic class mapping matrix (ACMM) allows the invention to probabilistically map the identified acoustic class in the noisy speech to an acoustic class in the underlying clean speech. Finally, the invention uses the identified acoustic classes to estimate the clean MFCC vector. Results show that one can improve PESQ in environments as low as −10 dB input SNR.

Other arguably related references include the following:

A. Acero, U.S. Pat. No. 7,047,047, "Non-Linear Observation Model for Removing Noise from Corrupted Signals", relates to a speech enhancement system to remove noise from a speech signal. The method estimates the noise, clean speech, and the phase between the clean speech and noise as three hidden variables. The model describing the relationship between these hidden variables is constructed in the log Mel-frequency domain. Many assumptions are invoked to allow the determination of closed-form solutions to the conditional probabilities and minimum mean square error (MMSE) estimators for the hidden variables. The use of the noise-reduced feature vectors for reconstruction of the enhanced speech signal for human listening is not addressed. This system operates in the log mel frequency domain rather than in the mel frequency cepstral domain. One of the benefits of the present invention is that it can operate directly in the cepstral domain, allowing for utilization of excellent acoustic modeling of that particular domain. Acero's system explicitly computes an estimate of the noise signal, whereas the present invention models the perturbation to the clean speech features due to noise. Furthermore, the removal of noise (speech enhancement) in Acero's system uses distinctly different methods. Since the present invention operates in a different feature domain (mel-frequency cepstrum rather than mel-frequency spectrum), it cannot make many of the assumptions of the Acero system. Rather, the invention statistically modifies the MFCCs of the noisy signal. The statistical modification of the MFCCs is based on the target statistics of the GMM of the MFCCs from the clean training speech signal. Finally, the use of the noise-reduced feature vectors for reconstruction of the enhanced speech signal for human listening is not addressed in Acero's system.

A. Acero, U.S. Pat. No. 7,165,026—"Method of Noise Estimation Using Incremental Bayes Learning", addresses the estimation of noise from a noisy speech signal. The present invention does not rely on an estimate of noise but rather on a model of the perturbations to clean speech due to noise. This patent does not directly address the use of a noise estimate for speech enhancement, but invokes U.S. Pat. No. 7,047,047 (described above) as one example of a methodology to make use of the noise estimate.

M. Akamine, U.S. Patent Pub. No. 2007/0276662, "Feature-Vector Compensating Apparatus, Feature-Vector Compensating Method, and Computer Product", describes a method for compensating (enhancing) speech in the presence of noise. In particular, the method describes a means to compute compensating vectors for a plurality of noise environments. Given noisy speech, the degree of similarity to each of the known noise environments is computed, and this estimate of the noise environment is used to compensate the noisy feature vector. Moreover, a weighted average of compensated feature vectors can be used. The specific compensating (enhancement) method targeted by this invention is the SPLICE (Stereo-based Piecewise Linear Compensation for Environments) method, which makes use of the Mel-frequency Cepstral Coefficients (MFCCs) as well as delta and delta-delta MFCCs as acoustic feature vectors. Automatic speech recognition and speaker recognition are the specific applications targeted by the invention. The reconstruction of the enhanced speech signal for human listening is not addressed in Akamine's system. The use of the SPLICE method for compensation of the acoustic feature vectors (not covered by this publication but invoked as the targeted method of feature vector compensation) relies on the use of stereo audio recordings. The present invention uses single channel (i.e., one microphone) recordings for enhancement of speech. Furthermore, the SPLICE algorithm computes a piecewise linear approximation for the relationship between noisy speech feature vectors and clean speech feature vectors, invoking assumptions regarding the probability density functions of the feature vectors and the conditional probabilities. The present invention estimates the clean speech feature vectors by means of a novel acoustic class mapping matrix relating the individual component densities in the GMM for the clean speech and noisy model (modeling the perturbation of the clean speech cepstral vectors due to noise). The reconstruction of the enhanced speech signal for human listening is not addressed in Akamine's system, but rather this publication is targeting automatic speech or speaker recognition.

M. Akamine, U.S. Patent Pub. No. 2007/0260455, "Feature-Vector Compensating Apparatus, Feature-Vector Compensating Method, and Computer Program Product", describes a method for compensating (enhancing) speech in the presence of noise. This publication is very similar to the inventor's other publication discussed above. However, this publication uses a Hidden Markov Model (HMM) for a different determination of the sequence of noise environments in each frame than was used in the other publication.

A. Bayya, U.S. Pat. No. 5,963,899, "Method and System for Region Based Filtering of Speech", describes a speech enhancement system to remove noise from a speech signal. The method divides the noisy signal into short time frames, classifies the underlying sound type, chooses a filter from a predetermined set of filterbanks, and adaptively filters the signal in order to remove noise. The classification of sound type is based on training the system using an artificial neural network (ANN). The above system operates entirely in the time-domain and this is stressed in the applications. That is, the system operates on the speech wave itself whereas our system extracts mel-frequency cepstral coefficients (MFCCs) from the speech and operates on these. There are many speech enhancement methods that operate in the time-domain whereas the present invention is the first to operate in the MFCC-domain, which is a much more powerful approach. Although both systems are trained to "recognize" sound types, the methods of training, classification, and definition of "types" are very different. In Bayya's system the sound types are phonemes such as vowels, fricatives, nasals, stops, and glides. The operator of the system must manually segment a clean speech signal into these types and train the ANN on these types a head of time. The noisy signal is then split up into frames and each frame is classified according to the ANN. In the present invention, one trains a Gaussian Mixture Model (GMM), which is a statistical model and very different from an ANN. The present invention is automatically trained in that one simply presents a user's clean speech signal and a parallel noisy version is automatically created and the model trained on both time-aligned signals. The present invention is user-dependent in that the model is trained for a single person who uses the system. Although Bayya's method is trained, their system is user-independent. The model of the present invention is not based on a few sound types at the level of phoneme but on much finer acoustic classes based on statistics of the Gaussian distribution of these acoustic classes. The present invention preferably uses between 15-40 acoustic classes and a Bayesian classifier of MFCCs in order to determine the underlying acoustic class in the noisy signal, which is significantly different than Bayya's invention. Based on the classification by the ANN, Bayya's system then chooses a filterbank and adaptively filters the noisy speech signal. The present invention preferably employs no noise-reduction filters (neither filterbanks nor adaptive filters) but rather statistically modifies the MFCCs of the noisy signal. The statistical modification of the MFCCs is based on the target statistics of the GMM of the MFCCs from the clean training speech signal. Finally, in Bayya's system the enhanced speech signal is "stitched" together by simply overlapping and adding the time-domain speech frames. The present invention employs a more elaborate method of reconstructing the speech signal since it operates in the MFCC-domain. The present invention also provides a new method to invert the MFCCs back into the speech waveform based on inverting each of the steps in the MFCC process.

H. Bratt, U.S. Patent Pub. No. 2008/0010065, "Method and Apparatus for Speaker Recognition", describes a system for speaker recognition (SR) that is for recognizing a speaker based on their voice signal. This publication does not address enhancing a speech signal, i.e., removing noise for human listening which is the subject of the present invention.

J. Droppo, U.S. Pat. No. 7,418,383, "Noise Robust Speech Recognition with a Switching Linear Dynamic Model", describes a method for speech recognition (i.e., speech-to-text) in the presence of noise using Mel-frequency cepstral coefficients as a model of acoustic features and a switching linear dynamic model for the time evolution of speech. The inventors describe a means to model the nonlinear manner in which noise and speech combine in the Mel-frequency cepstral coefficient domain as well as algorithms for reduced computational complexity for determination of the switching linear dynamic model. Since this method specifically targets automatic speech recognition, the reconstruction of the enhanced speech for human listening is not addressed in this patent. This system uses a specific model (Switching Linear Dynamic Model) for the time evolution of speech. The present invention does not invoke any model of the time-evolution of speech. The nonlinear model describing the relationship between clean speech and the noise is different than in the present invention. Firstly, the present invention models the relationship between the clean speech and the noisy signal rather than the relationship between the clean speech and the noise as in Droppo's invention. Secondly, the present invention models the perturbations of the clean feature vectors due to noise in terms of a novel acoustic class mapping matrix based on a probabilistic estimate of the relationship between individual Gaussian mixture components in the clean and noisy speech. Droppo's system estimates the clean speech and noise by invoking assumptions regarding the probability density functions (PDFs) of the speech and noise models, as well as the PDFs of the joint distributions of speech and noise. Droppo's system uses the minimum mean square error (MMSE) estimator, which the present invention preferably does not use under the preferred constraints (using the noisy and clean speech rather than the noise and clean speech). Furthermore, Droppo's invention does not address the reconstruction of the enhanced speech for human listening.

B. Frey, U.S. Pat. No. 7,451,083, "Removing Noise from Feature Vectors", describes a system for speech enhancement, i.e., the removal of noise from a noisy speech signal. Separate Gaussian mixture models (GMMs) are used to model the clean speech, the noise, and the channel distortion. Moreover, the relationship between the observed noisy signal and the clean speech, noise, and channel distortion is modeled via a non-linear relationship. In the training stage, the difference between the computed noisy signal (invoking the non-linear relationship) and the measured noisy signal is computed. An estimate of the clean speech feature vectors given the noisy speech feature vectors is determined by computing the most likely combination of clean speech, noise, and channel distortion given the models (GMMs) previously computed. The difference between the computed noisy signal and the measured noisy signal is used to further refine the estimate of the clean speech feature vector. This patent does not address the use of the enhanced feature vectors for human listening. This system does not enhance speech to improve human listening of the signal as the present invention does nor does it convert the MFCCs back to a speech waveform as required for human listening. In the present invention we also create a GMM of clean speech. In the present invention, however, one does not assume access to the noise (or channel distortion), and thus one does not explicitly model the noise. Rather, one models the noisy speech signal with a separate GMM. One then links the two GMMs (clean and noisy) via a novel mapping matrix thus solving a major problem in how one can relate the two GMMs to each other. In Frey's system, the clean speech, noise, and channel distortion are all estimated by means of computing the most likely combination of speech, noise, and channel distortion (by means of a joint probability density function). The present invention also estimates a clean MFCC vector from the noisy one but does not use a maximum likelihood calculation over the combinations of speech and noise. These estimates are used in addition to the nonlinear model of the mixing of speech, noise, and channel distortion to estimate the clean speech feature vectors. The present invention rather uses the probabilistic mapping between noisy and clean acoustic classes (individual GMM component densities) provided by a novel acoustic class mapping matrix and modification of the noisy cepstral vectors to have statistics matching the clean acoustic classes.

Y. Gong, U.S. Pat. No. 6,633,842, "Sequential Determination of Utterance Log-Spectral Mean By Maximum a Posteriori Probability Estimation", describes a system for improving automatic speech recognition (ASR), i.e., speech to text when the speech signal is subject to noise. This patent does not address enhancing a speech signal, i.e., removing noise for human listening. This patent is for a system that modifies a Gaussian Mixture Model (GMM) trained on MFCCs derived from clean speech so that one has a GMM for the noisy speech. To do this, the inventor adds an estimate of the noise power spectrum to the clean speech power spectrum, converts the estimated noisy speech spectrum to MFCC coefficients, and modifies the clean GMM parameters accordingly. The inventor's point of having two GMMs—one for clean speech and one for noisy speech—is to apply a standard statistical estimator equation so that one may estimate the clean speech feature vector. By using an estimate of the clean speech feature vector instead of the actual noisy feature vector, ASR may be improved in noisy environments. The above system creates a new a GMM for noisy speech so that it can be used in a machine-based ASR—this system does not enhance speech to improve human listening of the signal nor does it convert the MFCCs back to a speech waveform as required for human listening. In the present invention one also creates a GMM of noisy speech. In the present invention, however, one does not estimate the noise power spectrum but rather creates a noisy speech signal, extracts MFCCs, and builds a GMM from scratch—one does not modify the clean GMM. One then links the two GMMs (clean and noisy) via a novel mapping matrix, thus solving a major problem in how one can relate the two GMMs to each other. The invention also estimates a clean MFCC vector from the noisy one but does not use a conditional estimator. One cannot assume that the component densities of the GMMs are jointly Gaussian and thus the present invention resorts to a novel, non-standard estimator.

Y. Gong, U.S. Pat. No. 7,062,433, "Method of Speech Recognition with Compensation for Both Channel Distortion and Background Noise", describes a system for improving automatic speech recognition (ASR), i.e., speech to text when the speech signal is subject to channel distortions and noise background. This patent does not address enhancing a speech signal, i.e., removing noise for human listening. The patent is directed to a system that modifies Hidden Markov Models (HMMs) trained on clean speech. To do this, the inventors add the mean of the MFCCs of the clean training signal to each of the models and subtract the mean of the MFCCs of the estimate of the noise background from each of the models. By doing this, the models are adapted for ASR in noisy environments and thus improved word recognition. The system modifies HMMs (based on clean versus noisy speech) used in a machine-based ASR—this system does not enhance speech to improve human listening of the signal nor does it convert the MFCCs back to a speech waveform as required for human listening. In Gong's work, the models for the ASR system are modified (by simple addition and subtraction of mean vectors) and not the MFCCs themselves as in the present invention. Furthermore, with the present invention direct enhancement of MFCCs includes modifications based on the covariance matrix and weights of component densities of the GMM of the MFCCs and not just the mean vector. In Gong's system, the mean MFCC vector is computed from an estimate signal whereas in the present invention the statistics of the noisy signal are first computed through a training session involving a synthesized noisy signal. In Gong's work there is no training session based on a noisy signal. Finally, in Gong's work there is no description of using the system for enhancement of noisy speech—it is only used for compensating a model in ASR when the signal is noisy.

H. Jung, U.S. Patent Pub. No. 2009/0076813, "Method for Speech Recognition using Uncertainty Information for Subbands in Noise Environment and Apparatus Thereof", describes a system for improving automatic speech recognition (ASR), i.e., speech-to-text in the presence of noise. This patent does not address enhancing a speech signal, i.e., removing noise for human listening. The invention uses subbands and weights those frequency bands with less noise more so than those with more noise. In doing so, better ASR can be achieved. In this publication, no attempt is made to remove noise or modify models.

S. Kadambe, U.S. Pat. No. 7,457,745, "Method and Apparatus for Fast On-Line Automatic Speaker/Environment Adaptation for Speech/Speaker Recognition in the Presence of Changing Environments", describes a system for automatic speech recognition (ASR) and speaker recognition (SR) that can operate in an environment where the speech sounds are distorted. The underlying speech models are adapted or modified based on incorporating the parameters of the distortion into the model. By modifying the models, no additional training is required in the noisy environment and ASR/SR accuracy is improved. This system does not enhance speech to improve human listening of the signal as in the present invention nor does it convert the MFCCs back to a speech waveform as required for human listening.

K. Kwak, U.S. Patent Pub. No. 2008/0065380, "On-line Speaker Recognition Method and Apparatus Thereof", describes a system for speaker recognition (SR) that is for identifying a person by the voice signal. This patent does not address enhancing a speech signal, i.e., removing noise for human listening. The work contained in this publication is reminiscent of that published by D. Reynolds et al., "Robust Text-Independent Speaker Identification Using Gaussian Mixture Speaker Models," IEEE Trans. Signal Process., vol. 3, no. 1, pp. 72-83, January 1995. Although the inventors describe using a Wiener filter to remove noise from the signal prior to identification, this publication has nothing to do with removing noise from a speech signal for purposes of enhancing speech for human listening.

E. Marcheret, U.S. Patent Pub. No. 2007/0033042, "Speech Detection Fusing Multi-Class Acoustic-Phonetic, and Energy Features", describes a method for detection of the presence of speech in a noisy background signal. More specifically, this method involves multiple feature spaces for determination of speech presence, including mel-frequency cepstral coefficients (MFCCs). A separate Gaussian mixture model (GMM) is used to model silence, disfluent sounds, and voiced sounds. A hidden Markov model (HMM) is also used to model the context of the phonemes. This method does not address the enhancement of noisy speech, but only the detection of speech in a noisy signal. In Marcheret's system the sound types are broad phonetic classes such as silence, unvoiced, and voiced phonemes. It is unclear from the publication whether the operator of the system must manually segment speech into silence, unvoiced, and voiced frames for training. Each of these broad phonetic classes is modeled by a separate GMM. In the present invention, one also trains a GMM, but the system is automatically trained in that one simply presents a user's clean speech signal and a parallel noisy version is automatically created and the model trained on both time-aligned signals. The model of the present invention is not based on a few sound types at the level of phoneme but on much finer acoustic classes based on statistics of the Gaussian distribution of these acoustic classes. The present invention preferably uses between 15-40 acoustic classes. Furthermore, the present invention is not targeted to the detection of speech in a noisy signal but for the enhancement of that noisy speech.

M. Seltzer, U.S. Pat. No. 7,454,338, "Training Wideband Acoustic Models in the Cepstral Domain Using Mixed-Bandwidth Training Data and Extended Vectors for Speech Recognition", describes a method to compute wideband acoustic models from narrow-band (or mixed narrow- and wide-band) training data. This method is described to operate in both the spectrum and cepstrum; in both embodiments, the method provides a means to estimate the missing high-frequency spectral components induced by use of narrowband (telephone channel) recordings. This method does not address enhancing a speech signal, i.e., removing noise for human listening.

J. Wu, U.S. Patent Pub. No. 2005/0182624, "Method and Apparatus for Constructing a Speech Filter Using Estimates of Clean Speech and Noise", describes a means to enhance speech in the presence of noise. The clean speech and noise are estimated from the noisy signal and used to define filter gains. These filter gains are used to estimate the clean spectrum from the noisy spectrum. The use of both Mel-frequency cepstral coefficients and regular cepstral coefficients (no Mel weighting) are both addressed as possible acoustic feature vectors. The observed noisy feature vector sequence is used to estimate the noise model (possibly a single Gaussian) in a maximum likelihood sense. The clean speech model is a Gaussian mixture model (GMM). Estimates of the clean speech and noise are determined from the noisy signal with a minimum mean square error (MMSE) estimate. The clean speech and noise estimates (in the cepstral domain) are taken back to the spectral domain. These spectral estimates are smoothed over time and frequency and are used to estimate Wiener filter gains. This Wiener filter is used to filter the original noisy spectral values to generate the spectrum of clean speech. This clean spectrum can be used either to reconstruct the original signal or to generate clean MFCCs for automatic speech recognition. The present invention makes no assumption concerning the noise, but rather models the perturbation of the clean speech due to the noise. Furthermore, Wu's invention estimates the clean speech in the spectral domain by means of a Wiener filter applied to the noisy spectrum. The present invention estimates the clean speech in the cepstrum by a novel acoustic class mapping matrix relating the individual component densities in the GMM for the clean speech and noisy model (modeling the perturbation of the clean speech cepstral vectors due to noise). One of the benefits to the present invention is that it can operate directly in the cepstral domain, allowing for utilization of the excellent acoustic modeling of that particular domain. While both methods make use of Mel-frequency cepstral coefficients and Gaussian mixture models to model clean speech, this is a commonly accepted means for acoustic modeling, specifically for automatic speech recognition as targeted by Wu's invention. Furthermore, Wu uses the minimum mean square error (MMSE) estimator for clean speech and noise. With the present invention, using the noisy and clean speech rather than the clean speech and noise, one cannot rely on the use of a MMSE estimator for estimation of the clean speech. Rather, one uses knowledge of the relationship between individual component densities in the GMM for both clean and noisy speech to modify the noisy MFCCs to have statistics closer to the anticipated clean speech component density. Finally, while the patent does mention that the clean spectrum estimate can be used to reconstruct speech, specifics of this reconstruction are not addressed. Rather, the focus of Wu's invention appears to be the use of the clean spectrum for subsequent computation of clean MFCCs for use in automated speech recognition. Furthermore, the present invention does not make use of any smoothing over time or frequency as does Wu in his invention.

BRIEF SUMMARY OF THE INVENTION

The present invention is of a speech enhancement method (and concomitant computer-readable medium comprising computer software encoded thereon), comprising: receiving samples of a user's speech; determining mel-frequency cepstral coefficients of the samples; constructing a Gaussian mixture model of the coefficients; receiving speech from a noisy environment; determining mel-frequency cepstral coefficients of the noisy speech; estimating mel-frequency cepstral coefficients of clean speech from the mel-frequency cepstral coefficients of the noisy speech and from the Gaussian mixture model; and outputting a time-domain waveform of enhanced speech computed from the estimated mel-frequency cepstral coefficients. In the preferred embodiment, constructing additionally comprises employing mel-frequency cepstral coefficients determined from the samples with additive noise. The invention additionally comprises constructing an acoustic class mapping matrix from a mel-frequency cepstral coefficient vector of the samples to a mel-frequency cepstral coefficient vector of the samples with additive noise. Estimating comprises determining an acoustic class of the noisy speech. Determining an acoustic class comprises employing one or both of a phromed maximum method and a phromed mixture method. Preferably, the number of acoustic classes is five or greater, more preferably 128 or fewer, and most preferably 40 or fewer. The invention improves perceptual evaluation of speech quality of noisy speech in environments as low as about −10 dB signal-to-noise ratio, and operates without modification for noise type.

Further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE SEVERAL VIEWS OF THE DRAWINGS

The accompanying drawings, which are incorporated into and form a part of the specification, illustrate one or more embodiments of the present invention and, together with the description, serve to explain the principles of the invention. The drawings are only for the purpose of illustrating one or more preferred embodiments of the invention and are not to be construed as limiting the invention. In the drawings.

DETAILED DESCRIPTION OF THE INVENTION

The present invention is of a two-stage speech enhancement technique (comprising method, computer software, and apparatus) that leverages a user's clean speech received prior to speech in another environment (e.g., a noisy environment). In the training stage, a Gaussian Mixture Model (GMM) of the mel-frequency cepstral coefficients (MFCCs) of the clean speech is constructed; the component densities of the GMM serve to model the user's "acoustic classes." In addition, a GMM is built using MFCCs computed from the same speech signal but with additive noise, i.e., time-aligned clean and noisy data. In the final training step, an acoustic class mapping matrix (ACMM) is constructed which links the MFCC vector from a noisy speech frame modeled by acoustic class to the MFCC vector from the corresponding clean speech frame modeled by acoustic class. Preferably, the acoustic class mapping matrix (ACMM) is constructed such that it links the MFCC vector from a noisy speech frame modeled by acoustic class k to the MFCC vector from the corresponding clean speech frame modeled by acoustic class j.

In the enhancement stage, MFCCs from the noisy speech signal are computed and the underlying acoustic class is identified via a maximum a posteriori (MAP) decision and a novel mapping matrix. The associated GMM parameters are then used to estimate the MFCCs of the clean speech from the MFCCs of the noisy speech. Finally, the estimated MFCCs are transformed back to a time-domain waveform. Results show that one can improve PESQ in environments as low as −10 dB SNR. The number of acoustic classes can be quite large, but 128 or fewer are preferred, and between 5 and 40 are most preferred.

Preferably, the noise is not explicitly modeled but rather perturbations to the cepstral vectors of clean speech due to noise are modeled via GMMs and the ACMM. This is in contrast to previous work which assumes white noise or requires pre-whitening procedures to deal with colored noise, or requires an explicit model of the noise. The invention preferably also makes no assumptions about the statistical independence or correlation of the speech and noise, nor does it assume jointly Gaussian speech and noise or speech and noisy speech.

The preferred speech enhancement embodiment of the invention can be applied without modification for any noise type without the need for noise or other parameter estimation. The invention is computationally comparable to many of the other algorithms mentioned, even though it operates in the mel-cepstrum domain rather than the time or spectral magnitude domain. Additionally, the enhanced speech is directly reconstructed from the estimated cepstral vectors by means of a novel inversion of the MFCCs; the operation of this speech enhancement method in the mel-cepstrum domain may have further use for other applications such as speech or speaker recognition which commonly operate in the same domain.

Figure 1:
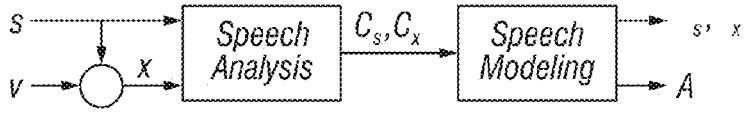
FIG. 1 is a block diagram of the training stage apparatus, method, and software according to the invention.

A block diagram of the training stage for the proposed speech enhancement system is given in FIG. 1. Assume a user's clean speech signal s and a noisy speech signal x synthesized from s and a representative noise signal v as $$x=s+v. \tag{1}$$

FIG. 1 also illustrates the time-aligned nature of the training data. In synthesizing x, the noise type (white, factory, etc.) and SNR should be chosen according to the known (or anticipated) operational environment. Additional care may be warranted in the synthesis of noisy speech, since speakers are known to modify their speaking style in the presence of noise.

Estimation of noise type and SNR can be achieved through analysis of the non-speech portions of the acquired noisy speech signal. In a real-time application, one could create a family of synthesized noisy speech training signals using different noise types and SNRs and select the appropriate noisy speech model based on enhancement performance.

The preferred cepstral analysis of speech signals is homomorphic signal processing to separate convolutional aspects of the speech production process; mel-frequency cepstral analysis has a basis in human pitch perception. The glottal pulse (pitch) and formant structure of speech contains information important for characterizing individual speakers, as well as for characterizing the individual acoustic classes contained in the speech; cepstral analysis allows these components to be easily elucidated.

In the speech analysis block of the training stage, it is preferred to use a 20 ms Hamming window (320 samples at a 16 kHz sampling rate) with a 50% overlap to compute a 62-dimensional vector of MFCCs denoted $C_s$, $C_x$ from s, x, respectively. The 62 MFCCs are based on an DFT length of 320 (the window length) and a DCT of length 62 (the number of mel-filters). The mel-scale weighting functions $\phi_i$, $0 \le i \le 61$ are derived from 20 triangular weighting functions linearly-spaced from 0-1 kHz, 40 triangular weighting functions logarithmically-spaced in the remaining bandwidth (to 8 kHz), and two "half-triangle" weighting functions centered at 0 and 8 kHz. The two "half-triangle" weighting functions improve the quality of the enhanced speech signal by improving the accuracy in the transformation of the estimated MFCC vector back to a time-domain waveform.

The second step in the training stage (FIG. 1) is to model the distribution of the time-aligned sequences of MFCC vectors $C_s$ and $C_x$. For this it is preferred to use a GMM given by $$p(C \mid \lambda) = \sum_{i=1}^{M} w_i p_i(C) \tag{2}$$

where M is the number of component densities, C is the 62-dimensional vector of MFCCs, $w_i$ are the weights, and $p_i(C)$ is the i-th component density $$p_i(C) = \frac{1}{(2\pi)^{D/2} |\sum_i|^{1/2}} \exp\left\{-\frac{1}{2}(C-\mu_i)^T \sum_i^{-1} (C-\mu_i)\right\} \tag{3}$$

where D=62 is the dimensionality of the MFCC vector, $\mu_i$ is the mean vector, and $\Sigma_i$ is the covariance matrix (assumed to be diagonal). Each GMM is parametrized by $\lambda=\{w_i,\mu_i,\Sigma_i\}$, $1 \le i \le M$ and denote the GMMs for $C_s$, $C_x$ by $\lambda_s$, $\lambda_x$ respectively as in FIG. 1. The GMM parameters are computed via the Expectation Maximization (EM) algorithm. It is preferred to use a GMM to model the distribution of MFCC vectors and to use the individual component densities as models of distinctive acoustic classes for more specialized enhancement over the acoustic classes. This differs from SR work where the GMM as a whole (likelihoods are accumulated over all component densities) is used to model the speaker.

In the EM computation of the GMM parameters, there is no guarantee that the j-th component density in $\lambda_s$ models the same acoustic class as the j-th component density in $\lambda_x$ since the noise perturbs the sequence of MFCC vectors and therefore the GMMs. Thus, for each acoustic class, one must preferably link the corresponding component densities in $\lambda_s$ and $\lambda_x$.

The clean and noisy GMMs may reside in a different portion of the high-dimensional space and are expected to have considerably different shape. In the enhancement stage, the ACMM will enable one to identify the underlying clean acoustic class of the noisy speech frame and apply appropriate GMM parameters to ultimately estimate the MFCCs of the clean speech.

This correspondence, or mapping, from clean acoustic class to noisy acoustic class can be ascertained from the MFCC vectors. One can identify which acoustic class $C_s$, $C_x$ belongs to, given the GMM $\lambda_s$, $\lambda_x$ respectively by computing the a posteriori probabilities for the acoustic classes and identifying the acoustic class which has the maximum $$j = \operatorname*{argmax}_i p(i \mid C, \lambda) = \operatorname*{argmax}_i \frac{w_i p_i(C)}{p(C \mid \lambda)}. \tag{4}$$

With sufficiently long and phonetically diverse time-aligned training signals, one can develop a probabilistic model which enables one to map each component density in $\lambda_s$ to the component densities in $\lambda_x$. The following method gives a procedure for computing the ACMM, A:

Initialize A=0 for each MFCC vector $C_s$ and $C_x$ do $$j = \operatorname*{argmax}_i p(i \mid C_s, \lambda_s)$$

$$k = \operatorname*{argmax}_i p(i \mid C_x, \lambda_x)$$

$$A_{j,k} \leftarrow A_{j,k} + 1$$

end for $$A_{j,k} \leftarrow A_{j,k} \Big/ \sum_{i=1}^{M} A_{i,k} \text{ for } 1 \le j, k \le M.$$

The column-wise normalization of A provides a probabilistic mapping from noisy component density k (column of A) to clean component density j (row of A). Thus, each column of A (noisy acoustic class) contains probabilities of that noisy acoustic class having been perturbed from each of the possible clean acoustic classes (rows of A).

Figure 2A:
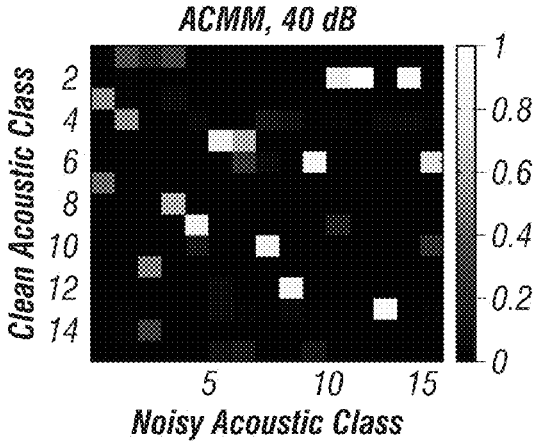
FIGS. 2(*a*) and 2(*b*) are illustrations of sparsity of ACMMs according to the invention for different SNRs for component densities; for high SNR, the ACMM approximates a permutation matrix; as SNR decreases, the ACMM becomes less sparse, making the decision of clean acoustic class given noisy acoustic class less certain.
Figure 2B:
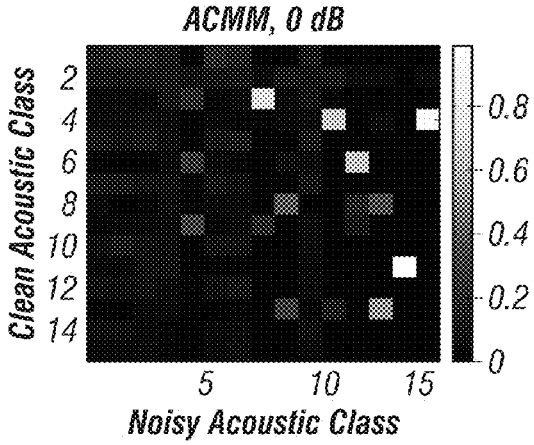

For high SNR, $C_x \approx C_s$ and A is therefore sparse (approximating a permutation matrix). Examples of A for an SNR of 40 dB and 0 dB are shown in FIG. 2. As SNR decreases, the noisy MFCC vectors are perturbed more, and A becomes less sparse. As A becomes less sparse, recalling that each column in A provides a probabilistic mapping to each of the clean acoustic classes, the decision of clean acoustic class given noisy acoustic class will become closer to a random guess.

Figure 3:
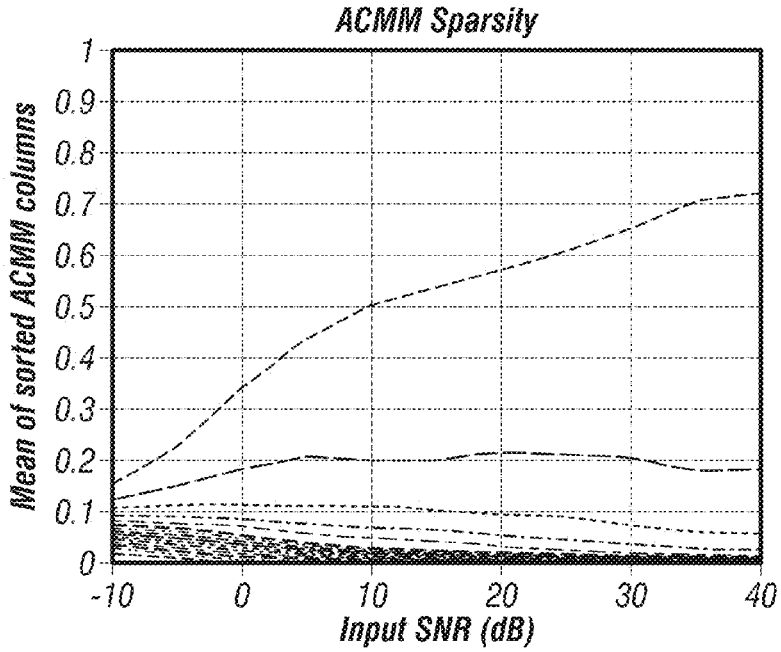
FIG. 3 is a graph of the mean of the sorted ACMM columns (sorted probabilities) versus SNR for M=15 component densities; a good mapping to a clean acoustic class can be made if the ACMM is relatively sparse (one dominant probability in the column of the ACMM); even for relatively low SNR (0 dB), the probability spread is still not random (an even spread of about 0.07)

As a further illustration of the effect of SNR on the sparsity of the ACMM, consider FIG. 3, where one averages all sorted columns of A for different values of input SNR for white Gaussian noise. Thus, the plot shows the average distribution of probabilities for a column of A given a particular SNR. For the plot in FIG. 3, a random guess has a probability of □0.07 for M=15 component densities. As long as the probabilities are not uniformly 0.07, one can make an educated decision about the underlying clean acoustic class in a noisy frame.

In FIG. 3 there is one dominant probability (approximately one-to-one correspondence between clean and noisy acoustic classes) for high values of SNR. This dominance diminishes as SNR decreases, but one does not have a uniform spread in probabilities even at 0 dB. It is thus expected that the ACMM can be leveraged to determine the underlying clean acoustic class for a noisy MFCC vector, even in low SNRs.

Figure 4:
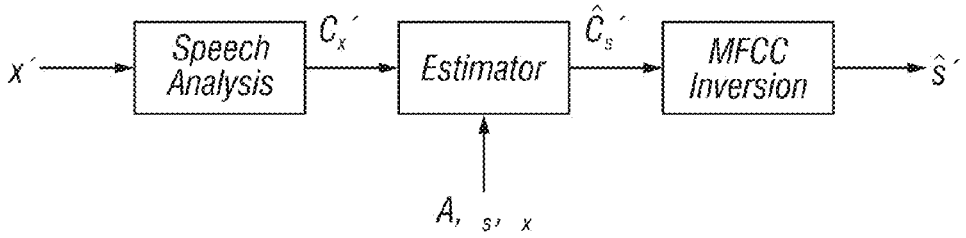
FIG. 4 is a block diagram of the speech enhancement stage apparatus, method, and software according to the invention.

This specification next describes the preferred enhancement stage illustrated in FIG. 4. Denote the noisy signal to be enhanced as x' and assume an additive noise model $$x' = s' + v'. \tag{5}$$

The signals s' and v' in (5) are different signals than s and v in (1). Assume, however, that s' is speech from the same speaker as s, v' is the same type of noise as v, and that x' is mixed from s' and v' at a SNR similar to that used in synthesizing x in the training stage. Mismatch in SNR and noise type will be considered below.

As in the training stage, compute the MFCC vector $C_{x'}$ from the noisy speech signal. The goal is to estimate $C_{s'}$ given $C_{x'}$, taking into account A, $\lambda_s$, and $\lambda_x$. One then reconstructs the enhanced time-domain speech signal s' from the estimate $\hat{C}_{s'}$.

The parameters for speech analysis in the enhancement stage are preferably identical to those in the training stage. A smaller frame advance, however, allows for better reconstruction in low-SNR environments due to the added redundancy in the overlap-add and estimation processes.

Once the MFCC vector $C_{x'}$ has been computed from the noisy speech signal, the noisy acoustic class is identified via $$k = \arg\max_{1 \le i \le M} p(i \mid C_x, \lambda_x). \tag{6}$$

Using the ACMM A, the noisy acoustic class k can be probabilistically mapped to the underlying clean acoustic class j, by taking the "most likely" estimate for the acoustic class $$\hat{j} = \operatorname*{argmax}_i A_{i,k}. \tag{7}$$

The clean acoustic class $\hat{j}$ is a probabilistic estimate of the true clean class identity for the particular speech frame.

The next step in the enhancement stage is to "morph" the noisy MFCC vector to have characteristics of the desired clean MFCC vector. Since spectral→cepstral in the original cepstrum vocabulary of Bogert, Healy, and Tukey, morphing→phroming. This cepstral phroming is more rigorously described as an estimation of the clean speech MFCC vector $C_{s'}$. This estimate is based on the noisy speech MFCC vector $C_{x'}$, noisy acoustic class k, ACMM A, and GMMs $\lambda_s$ and $\lambda_x$. The invention next presents two preferred phroming methods (estimators).

Equation (7) returns the maximum-probability acoustic class $\hat{j}$ and this estimate is used as follows. Since the k-th component density in $\lambda_x$ and the $\hat{j}$-th component density in $\lambda_s$ are both Gaussian (but not jointly Gaussian), a simple means of estimating $C_s$ is to transform the vector $C_{x'}$ (assumed Gaussian) into another vector $\hat{C}_{s'}$ (assumed Gaussian):

$$\hat{C}_{s'}=\mu_{s,\hat{j}}+(\Sigma_{s,\hat{j}})^{1/2}(\Sigma_{x,k})^{-1/2}(C_{x'}-\mu_{x,k}) \tag{8}$$

where $\mu_{s,\hat{j}}$ and $\Sigma_{s,\hat{j}}$ are the mean vector and (diagonal) covariance matrix of the $\hat{j}$-th component density of $\lambda_s$, and $\mu_{x,k}$ and $\Sigma_{x,k}$ are similarly defined for $\lambda_x$. This method is referred to as phromed maximum (PMAX).

Rather than using a single, or maximum probability acoustic class, it is preferred to use a weighted mixture of (8) with $A_{j,k}$ as the weights $$\hat{C}_{s'}=\sum_{j=1}^{M}A_{j,k}\left[\mu_{s,j}+\sum_{s,j}^{1/2}\sum_{x,k}^{-1/2}(C_{x'}-\mu_{x,k})\right]. \tag{9}$$

This phromed mixture (PMIX) method results in a superposition of the various clean speech acoustic classes in the mel-cepstrum domain, where the weights are determined based on the ACMM.

Due to the added redundancy in using a weighted average for the PMIX method, investigation shows that it consistently outperforms the PMAX method. However, it is shown below that PMAX has the potential for greatly increased performance if identification of the underlying clean acoustic class is improved.

It is worth noting the differences between PMAX and the optimal MMSE estimator for jointly Gaussian $C_s$ and $C_x$:

$$C_{s'}=\mu_{s,\hat{j}}+\Sigma_{(s,\hat{j}),(x,k)}\Sigma_{x,k}^{-1}(C_{x'}-\mu_{x,k}) \tag{10}$$

where $\Sigma_{(s,\hat{j}),(x,k)}$ is the cross-covariance between s of acoustic class $\hat{j}$ and x of acoustic class k. Note the cross-covariance term $\Sigma_{(s,\hat{j}),(x,k)}$ in (10) compared to the standard deviation term $(\text{gma}_{s,\hat{j}})^{1/2}$ in (8). The MMSE estimator in (10) assumes that $C_s$ and $C_x$ are jointly Gaussian, an assumption that we cannot make. Indeed, use of the "optimal" MMSE estimator (10) resulted in lower performance (mean-square error and PESQ) than either of the two phroming methods (8) and (9).

The final step in the enhancement stage (FIG. 4) is to inverse transform $\hat{C}_{s'}$ and obtain the speech frame s'. This is preferably achieved with the direct cepstral inversion (DCI) method summarized below, followed by a simple overlap-add reconstruction. Denote the spectrum of the enhanced speech frame as S'=DFT(s'). Define the mel-frequency cepstrum as $$\hat{C}_{s'}=\text{DCT}\{\log[\Phi|S'|^2]\} \tag{11}$$

where $\Phi$ is a bank of J mel-scale filters. In general, the speech frame, DFT, and DCT may be different lengths, but preferably choose (without loss of generality) length K for speech frame and the DFT, and length J for the DCT.

To invert the mel weighting, one finds $\Phi'$ such that $$|S'|^2=\Phi'\Phi|S'|^2\approx|S'|^2. \tag{12}$$

Defining as the Moore-Penrose pseudoinverse $\Phi^{\dagger}$ ($\Phi^{\dagger}=(\Phi^T\Phi)^{-1}\Phi^T$ for full rank $\Phi$), assure that $|S'|^2$ is the solution of minimal Euclidean norm. The remaining operations can be inverted without loss, since the DCT, DFT, log, and square operations are invertible, assuming that one uses the noisy phase (i.e., the phase of x') for inversion of the DFT. It has been shown previously that the phase of the noisy signal is the MMSE estimate for the phase of the clean signal.

The underconstrained nature of the mel cepstrum inversion introduces a degradation in PESQ of □0.2 points at very high SNR (for J>52), but these artifacts become masked by the noise below about 20 dB SNR.

The development above is based on a single GMM of the sequence of 62-D MFCC vectors. However, one finds significant speech enhancement improvement if the MFCC vector is partitioned into two subvectors $$C=\begin{bmatrix}C^f(13)\\C^p\end{bmatrix} \tag{14}$$

for separate modeling of format and pitch information, where $$C^f=[C(0),\ldots,C(12)]^T$$

$$C^p=[C(13),\ldots,C(61)]^T \tag{15}$$

and 'f' and 'p' refer to the formant and pitch subsets, respectively. The cutoff for the formant and pitch subsets is chosen based on the range of pitch periods expected for both males and females, translated into the mel-cepstrum domain.

In the preferred speech enhancement method of the invention, compute GMMs $\lambda_s^f$, $\lambda_s^p$, $\lambda_x^f$, $\lambda_x^p$ based on the sequence of MFCC subvectors $C_s^f$, $C_s^p$, $C_x^f$, $C_x^p$ respectively. ACMMs $A^f$, $A^p$ are computed with Algorithm 2.3 using $\{C_s^f,C_x^f\}$, $\{C_s^p,C_x^p\}$ respectively and $\hat{C}_{s'}^f$, $\hat{C}_{s'}^p$ are estimated using $\{C_{x'}^f,\lambda_s^f,\lambda_x^f\}$, $\{C_{x'}^p,\lambda_s^p,\lambda_x^{hmrp}\}$ respectively. Finally, the estimate of the clean MFCC vector is formed as the concatenation $$\hat{C}_{s'}=\begin{bmatrix}\hat{C}_{s'}^f(16)\\\hat{C}_{s'}^p\end{bmatrix} \tag{17}$$

followed by inversion of $\hat{C}_{s'}$ as described in the previous section. Speech enhancement results for the proposed method using a single GMM to model C or dual GMMs to model $C^f$ and $C^p$ are given next.

One separates the MFCCs into two subsets to better individually model formant and pitch information, rather than for computational reasons. Both formant (vocal tract configuration) and pitch (excitation) are important components to a total speech sound, but should be allowed to vary independently.

The system described above has been implemented and simulations run to measure average performance using ten randomly-chosen speakers (five male and five female) from the TIMIT corpus and noise signals from the NOISEX-92 corpus. Unless otherwise noted, speech frames are 320 samples in length (20 ms), training signals are ⊔ 24 s long with a frame advance of 160 samples, and test signals are ⊔ 6 s long with a frame advance of 1 sample. Additionally, unless otherwise noted, dual GMMs are used to model formant and pitch information and the number of GMM components M is 15 (diagonal covariance matrices) which is the minimum number leading to good enhancement performance. In most cases, the phromed mixture (PMIX) method in (9) is used as the estimator of the MFCC vector. Unless otherwise noted, s and s' are from the same speaker, v and v' are of the same noise type, and x and x' are mixed at the same SNR. Results are presented in terms of PESQ versus input SNR; PESQ has been shown to have the highest correlation to overall signal quality.

Figure 5:
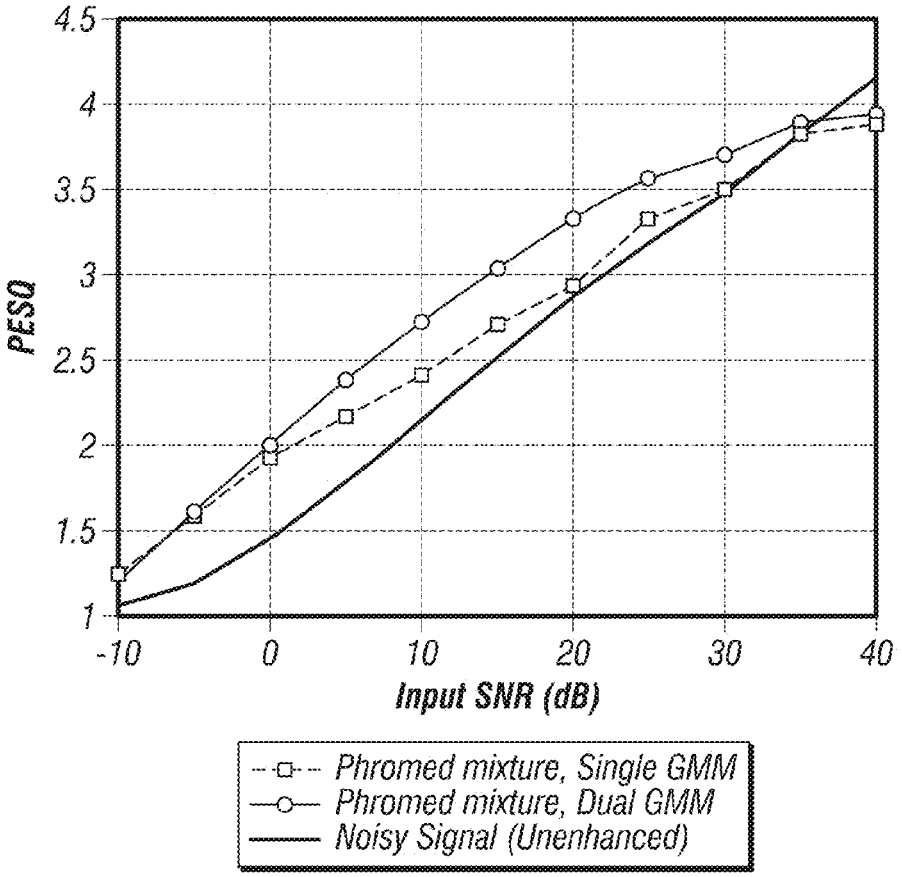
FIG. 5 is a graph of speech enhancement results (PESQ vs. input SNR) for the PMIX methods using a single GMM to model speech, and dual GMMs to separately model formant and pitch information; note the large increase in performance using the dual GMMs, especially for input SNR from 5-25 dB.
Figure 6A:
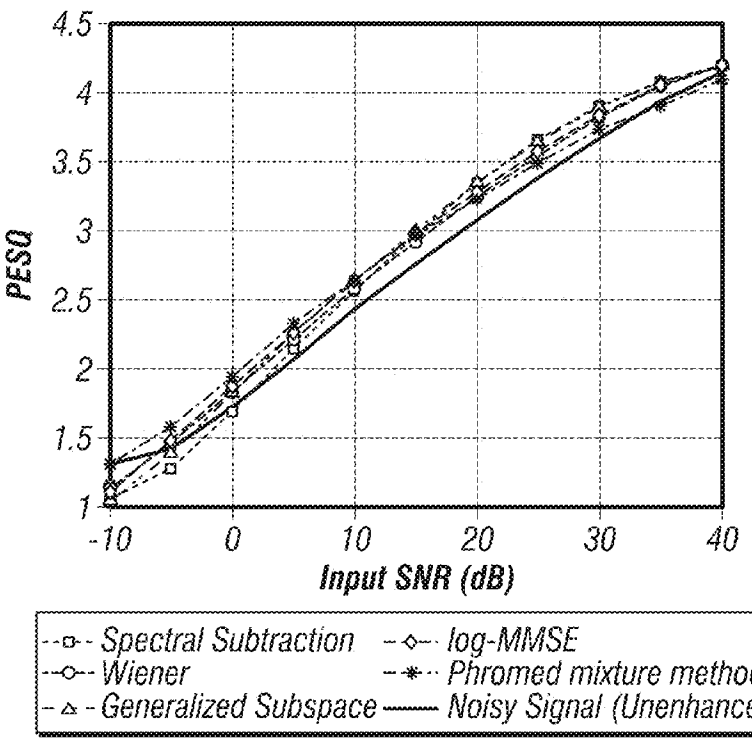
FIGS. 6(*a*)-6(*d*) are graphs of speech enhancement results (PESQ vs. input SNR) for the inventive phromed mixture (PMIX) method, spectral subtraction using oversubtraction, Wiener filtering using a priori SNR estimation, MMSE log-spectral amplitude estimatory, and generalized subspace method; NOISEX noise sources are used and results are averaged over ten TIMIT speakers; the inventive method can achieve an increase of 0.3-0.6 in PESQ over the noisy signal, depending on the noise type.
Figure 6B:
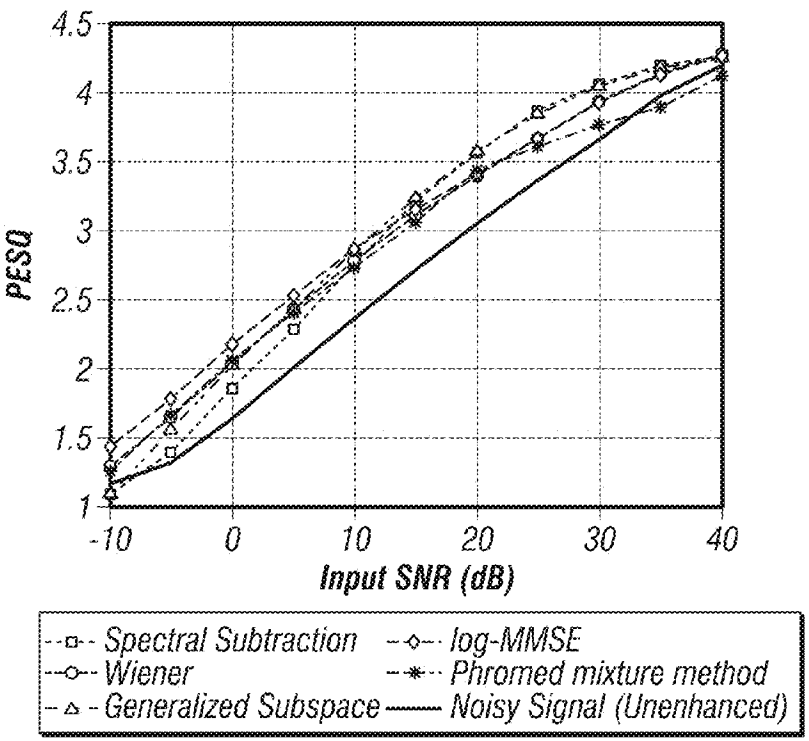
Figure 6C:
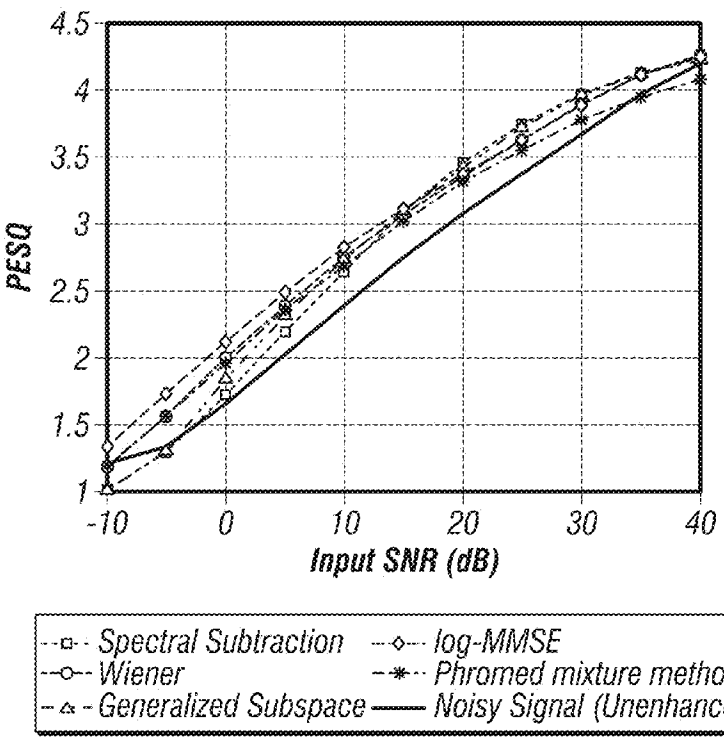
Figure 6D:
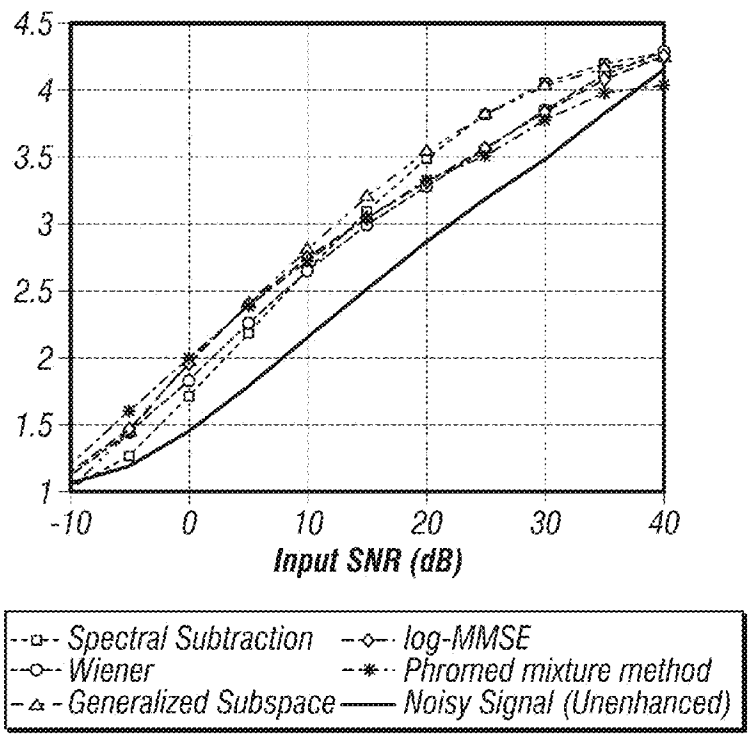

FIG. 5 illustrates the enhancement performance using dual GMMs to separately model the formant and pitch structure of speech versus a single GMM as described above. These results are for white Gaussian noise, although the same conclusions are expected to hold for other noise types. Note in FIG. 5 the large increase in performance when using dual GMMs rather than a single GMM, particularly in the input SNR range from 5-25 dB. At higher input SNRs (>35 dB) enough formant structure is preserved in the noisy cepstral vector that a single GMM, which primarily models pitch, is sufficient for an appropriate reconstruction. At lower input SNRs (<0 dB), the noisy cepstral vectors are perturbed enough that the advantage of separately modeling formant and pitch is masked by the noise.

FIG. 6 shows the performance of the proposed method for a variety of noise types. In addition, performance for spectral subtraction using oversubtraction, Wiener filtering using a priori SNR estimation, MMSE log-spectral amplitude estimator, and the generalized subspace method are provided for comparison. These methods improve upon the respective standard methods.

For the inventive method, one sees a maximum improvement in PESQ of 0.3-0.6 points over the unenhanced signal, depending on the noise type. In general, the proposed method has an input SNR operating range from −10 dB to +35 dB, with performance tapering off at the ends of the operating range. Phroming typically outperforms spectral subtraction using oversubtraction and Wiener filter using a priori SNR estimation for input SNRs below 15 dB and the generalized subspace method for input SNRs below 10 dB. Phroming is competitive (sometimes slightly better, sometimes slightly worse) than the MMSE log-spectral amplitude estimator. For further reference, the PESQ scores are shown in Table 1 for input SNRs between −10 and 15 dB.

TABLE 1

PESQ PERFORMANCE OF ENHANCEMENT METHODS IN THE PRESENCE OF DIFFERENT NOISE TYPES. SS REFERS TO SPECTRAL SUBTRACTION, WA TO WIENER FILTERING WITH A PRIORI SND ESTIMATION, GS TO THE GENERALIZED SUBSPACE METHOD, LM TO THE MMSE LOG-SPECTRAL AMPLITUDE ESTIMATOR, AND PM TO THE PHROMED MIXTURE ESTIMATION OF THE INVENTION. BOLD ENTRIES CORRESPOND TO THE BEST ENHANCEMENT PERFORMANCE ACROSS THE METHODS. SNRS FOR WHICH NO METHODS PROVIDE ENHANCEMENT HAVE NO BOLD ENTRIES.

| SNR | Noisy | SS | WA | GS | LM | PM |
|---|---|---|---|---|---|---|
| (a) Speech babble noise. | | | | | | |
| 15 | 2.75 | 2.96 | 2.92 | 3.00 | 2.97 | 2.96 |
| 10 | 2.43 | 2.56 | 2.58 | 2.63 | 2.63 | 2.64 |
| 5 | 2.07 | 2.14 | 2.20 | 2.25 | 2.26 | 2.32 |
| 0 | 1.72 | 1.69 | 1.83 | 1.82 | 1.87 | 1.94 |
| −5 | 1.42 | 1.27 | 1.46 | 1.38 | 1.48 | 1.58 |
| −10 | 1.31 | 1.06 | 1.13 | 1.04 | 1.11 | 1.31 |
| (b) F16 noise. | | | | | | |
| 15 | 2.72 | 3.21 | 3.11 | 3.24 | 3.15 | 3.06 |
| 10 | 2.36 | 2.75 | 2.78 | 2.86 | 2.86 | 2.73 |
| 5 | 2.00 | 2.28 | 2.42 | 2.43 | 2.52 | 2.40 |
| 0 | 1.64 | 1.85 | 2.04 | 2.02 | 2.17 | 2.05 |
| −5 | 1.32 | 1.39 | 1.64 | 1.55 | 1.78 | 1.66 |
| −10 | 1.16 | 1.09 | 1.29 | 1.08 | 1.43 | 1.26 |
| (c) Factory noise. | | | | | | |
| 15 | 2.74 | 3.09 | 3.07 | 3.09 | 3.11 | 3.02 |
| 10 | 2.64 | 2.75 | 2.43 | 2.73 | 2.82 | 2.68 |
| 5 | 2.02 | 2.19 | 2.39 | 2.31 | 2.48 | 2.36 |
| 0 | 1.65 | 1.72 | 1.99 | 1.84 | 2.11 | 1.95 |
| −5 | 1.33 | 1.29 | 1.56 | 1.30 | 1.72 | 1.56 |
| −10 | 1.21 | 1.01 | 1.18 | 1.01 | 1.33 | 1.19 |
| (d) White noise. | | | | | | |
| 15 | 2.51 | 3.09 | 2.99 | 3.20 | 3.04 | 3.04 |
| 10 | 2.15 | 2.65 | 2.65 | 2.80 | 2.75 | 2.72 |
| 5 | 1.79 | 2.19 | 2.25 | 2.40 | 2.40 | 2.39 |
| 0 | 1.45 | 1.71 | 1.83 | 1.97 | 1.95 | 2.00 |
| −5 | 1.19 | 1.26 | 1.44 | 1.44 | 1.46 | 1.60 |
| −10 | 1.06 | 1.03 | 1.13 | 1.02 | 1.15 | 1.21 |

Subjective evaluation of the resulting enhanced waveforms reveals good noise reduction with minimal artifacts. In particular, the musical noise present in the spectral subtraction and Wiener filtering methods is not apparent in the inventive method. There is, however some "breathiness" in the enhanced signal for low-SNR enhancements, most likely due to incorrect estimation of the clean acoustic class.

Figure 7:
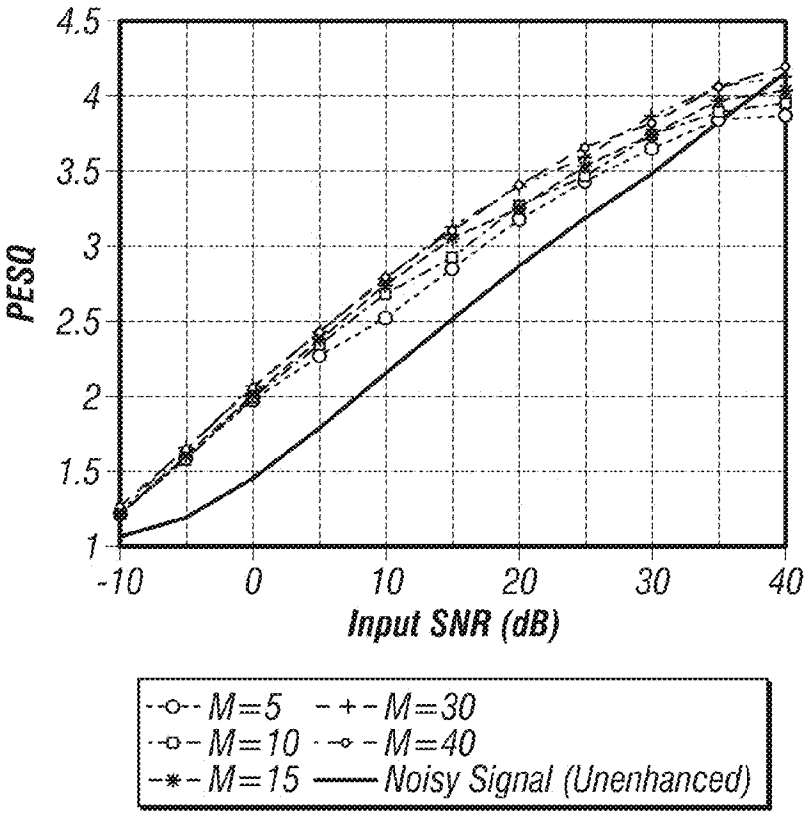
FIG. 7 is a graph of the effect of number of GMM component densities on enhancement performance in the presence of white noise; PESQ displays very small increases with increase in the number of component densities; this increase, however, is very small (below 0.05) when using more than 15 component densities.

The inventive method was conducted while varying the number of component densities M over the range $5 \leq M \leq 40$. As shown in FIG. 7, speech enhancement performance, as measured by PESQ, varies little with the number of component densities when the input SNR is below 5 dB. When the input SNR is between 10 and 30 dB, PESQ increases with increasing number of component densities, however, the increase is very small (below 0.05) when using more than 15 component densities. Therefore, as stated earlier, it is preferred to use 15 component densities in all simulations. Although this testing used white noise, similar conclusions hold for other noise types.

Figure 8:
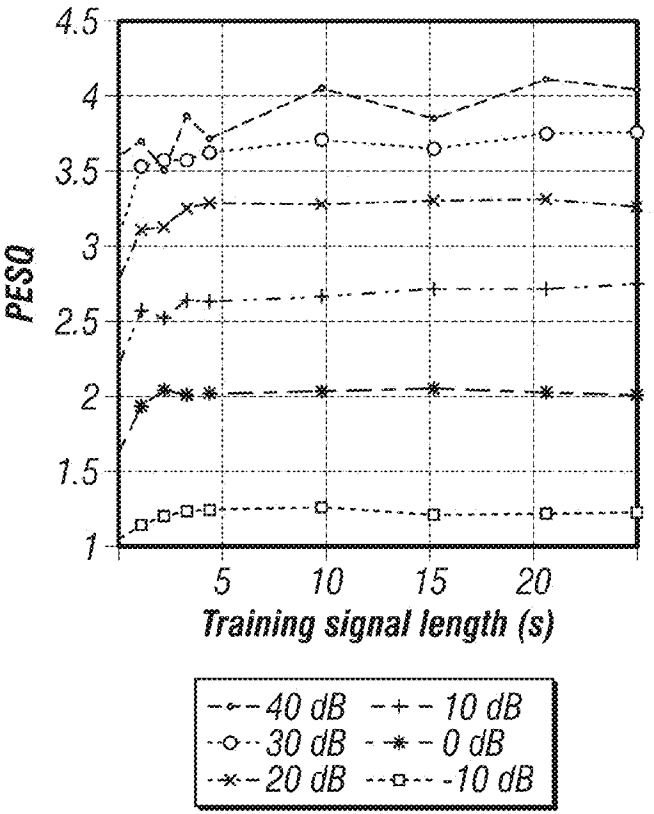
FIG. 8 is a graph of effect of training signal length on enhancement performance in the presence of white noise at various input SNRs; performance is degraded for training signals less than 3 s for phonetically diverse sentences.

In previous results, ⊔ 24 s speech signal was used for training. FIG. 8 illustrates the enhancement performance when using shorter training signals. These results are averaged over the 10 TIMIT speech signals using white noise at various SNRs—similar conclusions hold for other noise types. One generally sees performance degradation for training signals less than 3 s. This indicates that only a very short signal is required for appropriate modeling of 1) acoustic classes in the GMMs and 2) the perturbations of the acoustic classes in the presence of noise via the ACMMs. It is important to note, however, that TIMIT sentences are phonetically balanced; as such, the full range of acoustic classes are adequately represented in each sentence. It is expected that longer training signals may be required for less phonetically balanced utterances.

In previous results, it has been assumed that the operational environment is the same as the training environment in terms of input SNR and noise type. This specification next looks at the effect on enhancement performance when there is a mismatch between the training and operational noise environment.

Figure 9:
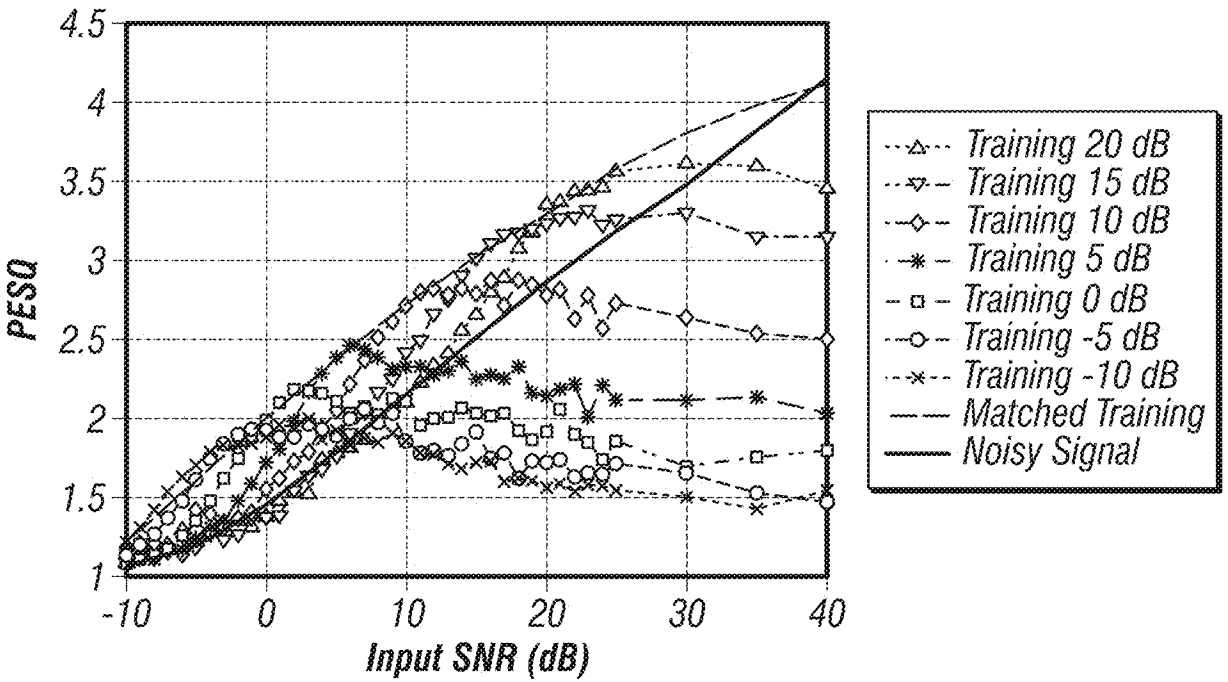
FIG. 9 is a graph of speech enhancement results (PESQ vs. input SNR) when input SNR differs from that used in training; note that it is better to underestimate the SNR of the operating environment, and that the performance saturates at or below the performance expected for the estimated SNR environment.
Figure 10B:
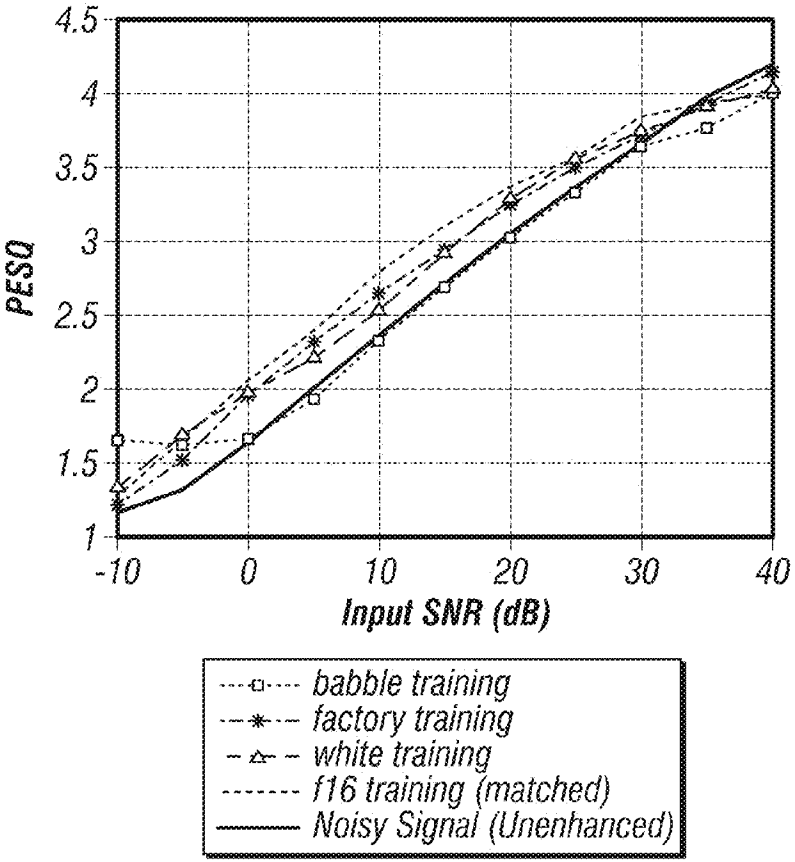
FIGS. 10(*a*)-10(*d*) are graphs of speech enhancement results (PESQ vs. input SNR) for the inventive PMIX method when the estimated noise type differs from that present in the operational environment; some noises (white) have more degradation in enhancement performance for mismatched noise type than others (babble); (a) shows speech babble noise in enhancement environment; (b) shows F16 noise in enhancement environment; (c) shows factory noise in enhancement environment; (d) shows white noise in enhancement environment.
Figure 10A:
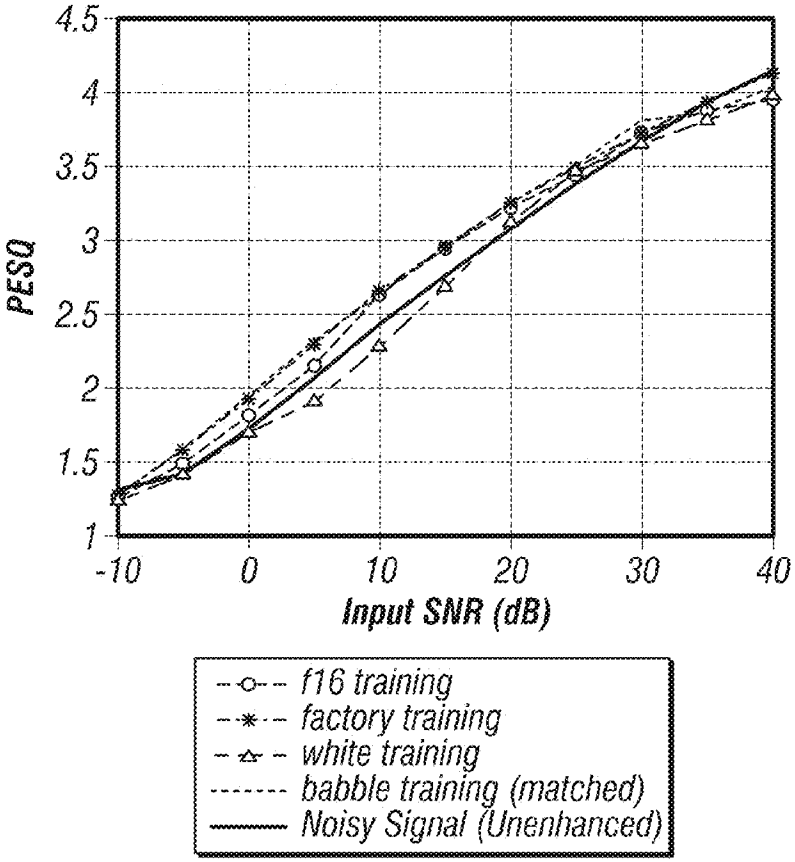
Figure 10C:
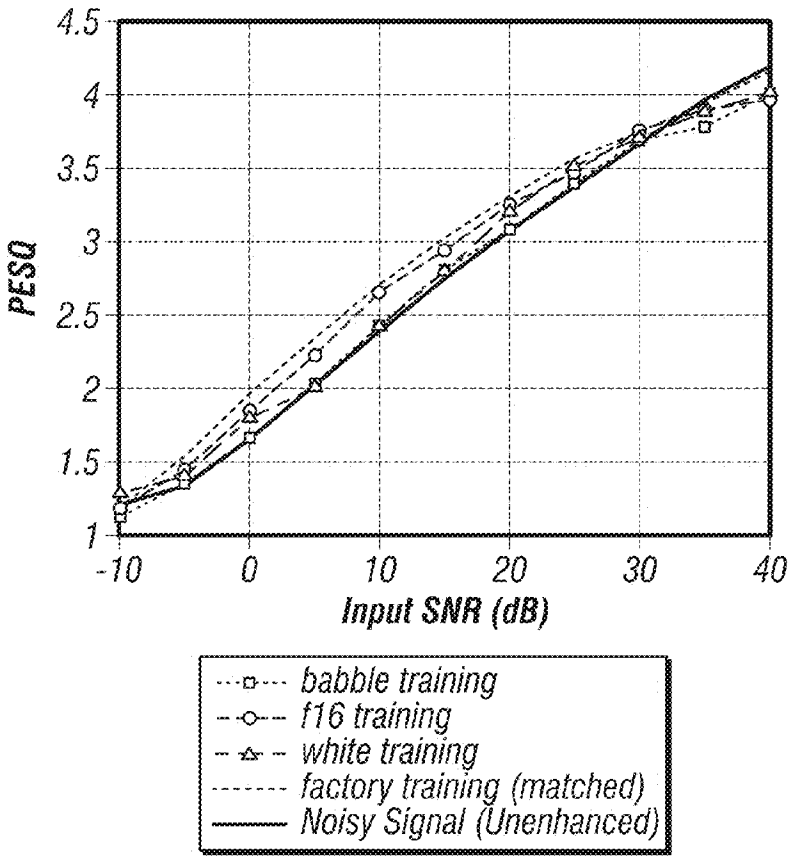
Figure 10D:
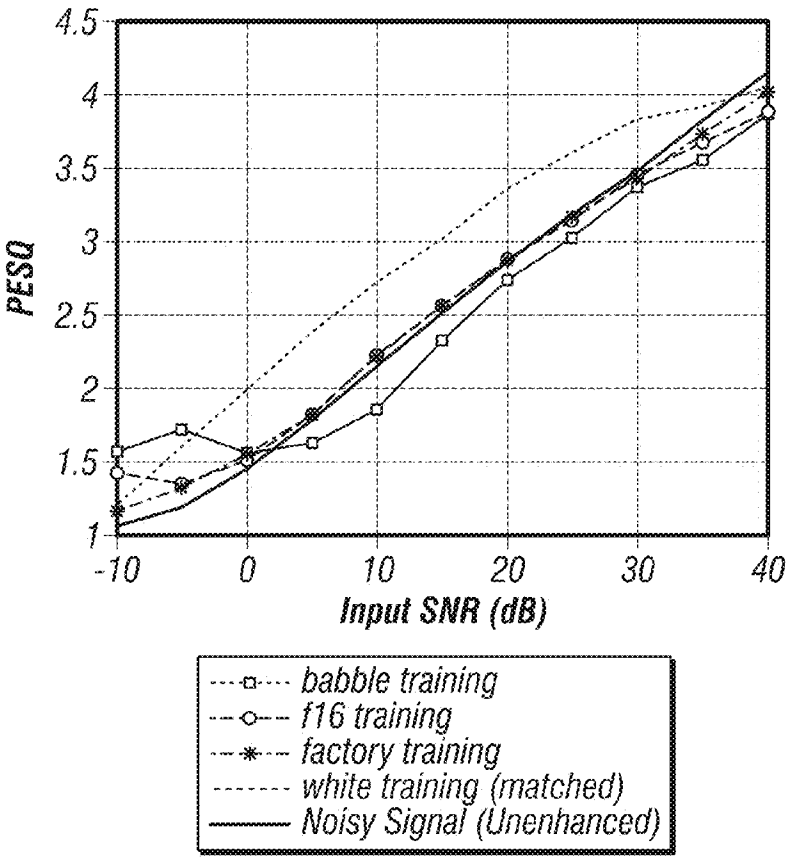

In FIG. 9, one plots PESQ versus the operational SNR; each of the curves corresponds to a different training SNR, as labeled in the legend. These results are for white Gaussian noise, but similar conclusions hold for other noise types.

Note a couple of important points regarding the results plotted in FIG. 9. First, it appears to be better to underestimate the SNR of the noise environment than to overestimate it. For example, assume that the system is trained for an expected 10 dB SNR noise environment. If the actual noise environment is 15 dB (the SNR was underestimated), the enhancement performance will be degraded by about 0.2 PESQ points compared to the matched case. On the other hand, if the actual noise environment is 5 dB (the SNR was overestimated), the enhancement performance will be degraded by about 0.3 PESQ points compared to the matched case. It is believed that the less-sparse nature of the ACMM for an underestimate allows for smaller degradation in performance, since the contribution of several likely clean acoustic classes are averaged.

Second, note that there is a saturation in PESQ enhancement performance at or below the performance expected for the estimated SNR environment. As an example, consider the maximum performance for a training SNR of 10 dB; even for enhancement in very high SNR environments, the enhancement performance is still approximately 2.5 PESQ, which is slightly lower than a matched 10 dB training and 10 dB operational environment. This is most likely due to the use of a less-sparse ACMM estimated at a lower SNR which will average the contributions of several acoustic classes.

Next, look at the effect of training with a noise type that is different from the operating environment. For these results, assume that the training and operational SNR are matched. FIG. 10 plots the enhancement performance for the proposed method for all possible training-operational combinations of the noise types plotted in FIG. 6.

In FIG. 10, one sees that some noise types are more susceptible to performance degradations due to noise type mismatch. White noise in particular has degraded enhancement performance if the system was trained with any other noise-type. On the other hand, certain noise types appear to be more robust to a noise type mismatch in training. For example, enhancement in an factory noise environment, when trained with babble noise, has very little degradation in PESQ performance.

There are three main sources of degradation which can limit enhancement performance for the inventive method. First, there is the distortion due to the direct cepstral inversion process. Second, there is the use of the noisy phase for inversion of the FFT. Third, there is the effect of improperly estimating the cepstrum $C_{s'}$. It is this third source that will be shown to have the largest effect on enhancement performance.

Figure 11:
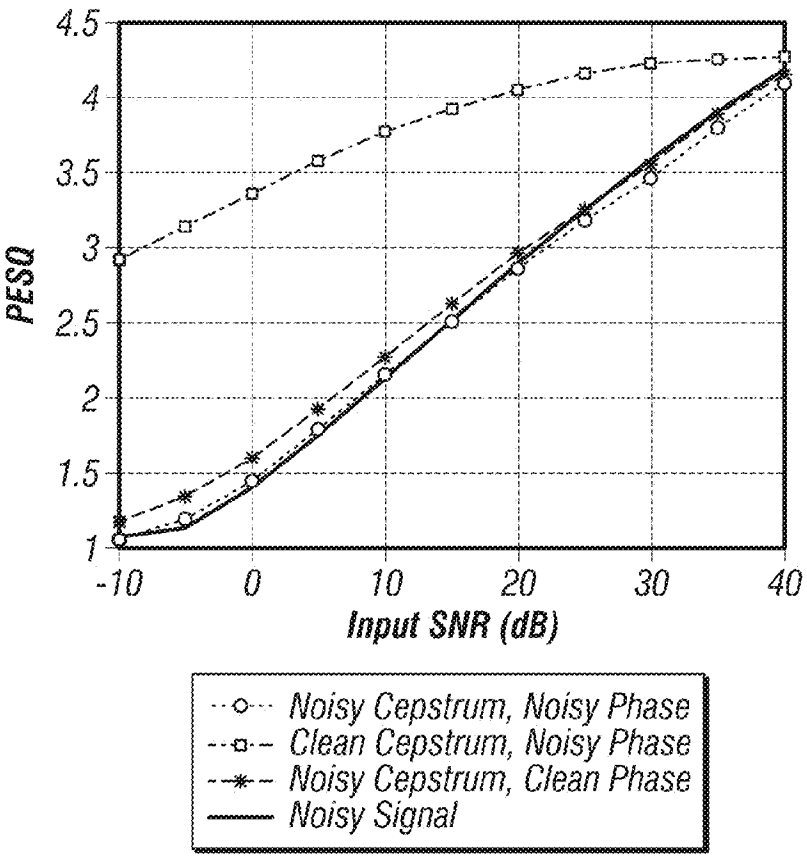
FIG. 11 is a graph of theoretical performance limits of the inventive method, using the actual clean cepstrum or clean phase for reconstruction of the speech signal; note that the use of the clean cepstrum has the largest effect on the PESQ.

As an illustration of the effects of these three sources of degradation on enhancement performance, consider the plot in FIG. 11, computed for white noise. Within this plot, the true clean cepstrum or clean phase is used prior to reconstruction of the speech.

First, note that when both the noisy cepstrum and noisy phase are used to reconstruct the speech, one sees a slight degradation of about 0.1 PESQ, compared to the noisy signal baseline, for very high input SNR (>25 dB), but that this distortion is masked by the noise below about 20 dB input SNR. This indicates that the DCI process may be responsible for a degradation of less than 0.1 PESQ points overall in the enhancement process.

Second, when the noisy cepstrum and clean phase are used to reconstruct the speech, one sees only incremental improvement in the PESQ. This indicates that a perfect estimate of the underlying clean phase information would by itself add only about 0.1 PESQ points to the overall enhancement. Indeed, the MMSE estimate of the clean phase is the noisy phase.

Third, when the clean cepstrum and noisy phase are used to reconstruct the speech, one sees a large increase in the PESQ. Thus, it appears that the estimation of the cepstrum of the speech is quite important to providing enhancement performance. Additionally, note that this is the theoretical limit of our proposed speech enhancement method since one seeks to estimate the underlying clean cepstrum and this simulation assumes a perfectly estimated clean cepstrum.

Figure 12:
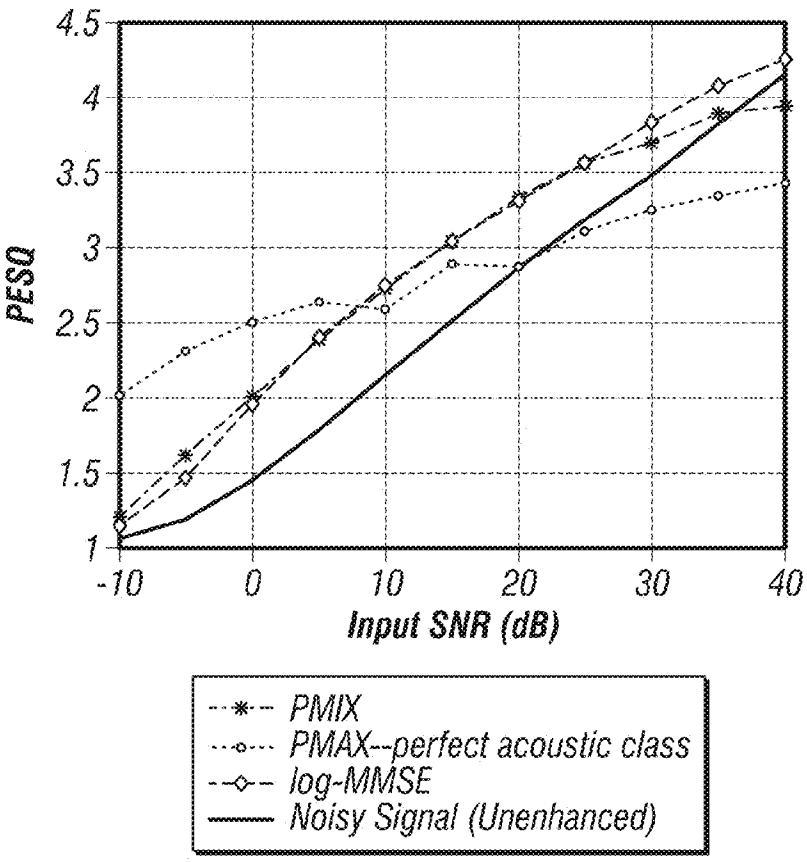
FIG. 12 is a graph of sources of errors in estimation of the clean cepstrum in the inventive method; a perfect determination of the underlying clean acoustic class (AC) provides a large increase in enhancement performance for PMAX, while perfect estimation of the frame energy (FE) provides incremental improvement in performance for both PMAX and PMIX.

As such, it is preferred to look at a major source of inaccuracy in the clean cepstrum estimate $\hat{C}_{s'}$. Specifically, within the PMAX estimation method, it is preferred to look at the underlying clean acoustic class through the ACMM. Since this is a probabilistic estimate of the clean acoustic class, there will be some speech frames with an incorrect estimate of acoustic class; FIG. 12 shows the effect of this acoustic class determination. Generally, the PMIX method outperforms the PMAX method for estimation of the clean cepstrum $C_s$ C. However, if one makes a more accurate identification of the underlying clean acoustic class, the PMAX method increases dramatically in performance.

The present invention provides a two-stage speech enhancement technique which uses GMMs to model the MFCCs from clean and noisy speech. A novel acoustic class mapping matrix (ACMM) allows one to probabilistically map the identified acoustic class in the noisy speech to a n acoustic class in the underlying clean speech. Finally, one can use the identified acoustic classes to estimate the clean MFCC vector. Results show that one can improve PESQ in environments as low as −10 dB input SNR.

The inventive method was shown to outperform spectral subtraction using oversubtraction, Wiener filter using a priori SNR estimation, and generalized subspace method and is competitive with the MMSE log-spectral amplitude estimator across a wide range of noise types for input SNRs less than ⊔ 15 dB. This enhancement performance is achieved even while working in the mel-cepstrum domain which imposes more information loss than any of the other tested methods. The implementation of this method in the mel-cepstrum domain has added benefit for other applications, e.g., automatic speaker or speech recognition in low-SNR environments.

While the preferred embodiment of the invention is directed to noisy environments, the invention is also useful in environments that are not noisy. The methods discussed in the attachment can be implemented on any appropriate combination of computer software and hardware (including Application Specific Integrated Circuits (ASICs), Field Programmable Gate Arrays (FPGAs, conventional Central Processing Unit (CPU) based computers, etc.), as understood by one of ordinary skill in the art.

Note that in the specification and claims, "about" or "approximately" means within twenty percent (20%) of the numerical amount cited. All computer software disclosed herein may be embodied on any computer-readable medium (including combinations of mediums), including without limitation CD-ROMs, DVD-ROMs, hard drives (local or network storage device), USB keys, other removable drives, ROM, and firmware.

Although the invention has been described in detail with particular reference to these preferred embodiments, other embodiments can achieve the same results. Variations and modifications of the present invention will be obvious to those skilled in the art and it is intended to cover in the appended claims all such modifications and equivalents. The entire disclosures of all references, applications, patents, and publications cited above are hereby incorporated by reference.

What is claimed is:

1. A speech enhancement method comprising the steps of:

receiving samples of a user's speech;

determining mel-frequency cepstral coefficients of the samples;

constructing a Gaussian mixture model of the coefficients;

receiving speech from a noisy environment;

determining mel-frequency cepstral coefficients of the noisy speech;

estimating mel-frequency cepstral coefficients of clean speech from the mel-frequency cepstral coefficients of the noisy speech and from the Gaussian mixture model; and outputting a time-domain waveform of enhanced speech computed from the estimated mel-frequency cepstral coefficients.

2. The method of claim 1 wherein the constructing step additionally comprises employing mel-frequency cepstral coefficients determined from the samples with additive noise.

3. The method of claim 2 additionally comprising constructing an acoustic class mapping matrix from a mel-frequency cepstral coefficient vector of the samples to a mel-frequency cepstral coefficient vector of the samples with additive noise.

4. The method of claim 3 wherein the estimating step comprises determining an acoustic class of the noisy speech.

5. The method of claim 4 wherein determining an acoustic class comprises employing one or both of a phromed maximum method and a phromed mixture method.

6. The method of claim 3 wherein the number of acoustic classes is five or greater.

7. The method of claim 6 wherein the number of acoustic classes is 128 or fewer.

8. The method of claim 7 wherein the number of acoustic classes is 40 or fewer.

9. The method of claim 1 wherein the method improves perceptual evaluation of speech quality of noisy speech in environments as low as about −10 dB signal-to-noise ratio.

10. The method of claim 1 wherein the method operates without modification for noise type.

11. A computer-readable medium comprising computer software encoded thereon, the software comprising:

code receiving samples of a user's speech;

code determining mel-frequency cepstral coefficients of the samples;

code constructing a Gaussian mixture model of the coefficients;

code receiving speech from a noisy environment;

code determining mel-frequency cepstral coefficients of the noisy speech;

code estimating mel-frequency cepstral coefficients of clean speech from the mel-frequency cepstral coefficients of the noisy speech and from the Gaussian mixture model; and code outputting a time-domain waveform of enhanced speech computed from the estimated mel-frequency cepstral coefficients.

12. The computer-readable medium of claim 11 wherein the constructing code additionally comprises code employing mel-frequency cepstral coefficients determined from the samples with additive noise.

13. The computer-readable medium of claim 12 additionally comprising code constructing an acoustic class mapping matrix from a mel-frequency cepstral coefficient vector of the samples to a mel-frequency cepstral coefficient vector of the samples with additive noise.

14. The computer-readable medium of claim 13 wherein the estimating code comprises code determining an acoustic class of the noisy speech.

15. The computer-readable medium of claim 14 wherein the code determining an acoustic class comprises code employing one or both of a phromed maximum method and a phromed mixture method.

16. The computer-readable medium of claim 13 wherein the number of acoustic classes is five or greater.

17. The computer-readable medium of claim 16 wherein the number of acoustic classes is 128 or fewer.

18. The computer-readable medium of claim 17 wherein the number of acoustic classes is 40 or fewer.

19. The computer-readable medium of claim 11 wherein the software improves perceptual evaluation of speech quality of noisy speech in environments as low as about −10 dB signal-to-noise ratio.

20. The computer-readable medium of claim 11 wherein the software operates without modification for noise type.

* * * * *